United States Patent [19]

Williams

[11] Patent Number: 4,777,917

[45] Date of Patent: Oct. 18, 1988

[54] ROTARY VALVE ENGINE WITH TANDEM POWER AND SUPERCHARGER SECTIONS

[76] Inventor: Thomas V. Williams, 415 Dreshertown Rd., Ft. Washington, Pa. 19034

[21] Appl. No.: 868,305

[22] Filed: May 28, 1986

[51] Int. Cl.[4] ..... F01L 7/00

[52] U.S. Cl. ..... 123/190 BA; 123/71 R; 123/65 V

[58] Field of Search ..... 123/58 AL, 58 R, 57 R, 123/57 A, 57 B, 62, 71 R, 80 BB, 80 R, 190 B, 190 BA, 65 V, 65 B, 68, DIG. 6

[56] References Cited

U.S. PATENT DOCUMENTS

| | | | |
|---|---|---|---|
| 773,490 | 10/1904 | Ferry | 123/81 B |
| 1,001,782 | 8/1911 | Steglat | 123/65 B |
| 1,361,978 | 12/1920 | George | 123/81 B |
| 1,510,651 | 10/1924 | Burtnett | 123/315 |
| 1,783,018 | 11/1930 | Johansson | 123/41.4 |
| 2,101,319 | 12/1937 | Moffit | 123/71 R |
| 2,938,506 | 5/1960 | Buchi | 123/311 |
| 2,984,966 | 5/1961 | Harris | 123/65 V |
| 3,288,123 | 11/1966 | Stinebaugh | 123/318 |
| 3,581,628 | 6/1971 | Williams | 92/73 |
| 4,090,478 | 5/1978 | Trimble et al. | 123/58 R |
| 4,135,478 | 1/1979 | Rassey | 123/DIG. 6 |
| 4,185,597 | 1/1980 | Cinquegrani | 123/71 R |
| 4,195,612 | 4/1980 | Klaue | 123/190 BA |
| 4,198,947 | 4/1980 | Rassey | 123/DIG. 6 |
| 4,205,638 | 6/1980 | Vlacaninch | 123/71 R |
| 4,279,225 | 7/1981 | Kersten | 123/80 BB |
| 4,392,460 | 7/1983 | Williams | 123/80 BB |
| 4,444,161 | 4/1984 | Williams | 123/190 BA |
| 4,610,223 | 9/1986 | Karlan | 123/190 BA |
| 4,632,081 | 12/1986 | Giuliani et al. | 123/DIG. 6 |

*Primary Examiner*—Willis R. Wolfe, Jr.
*Assistant Examiner*—M. Macy
*Attorney, Agent, or Firm*—Dann, Dorfman, Herrell and Skillman

[57] ABSTRACT

Four power cylinders within an engine and/or cylinder block are distributed around a central bore containing a rotary valve whose axis of rotation is parallel to that of each of the cylinders. Supercharger cylinders are axially aligned with the power cylinders and pistons within the power cylinders are connected by a rod to pistons within the supercharger cylinders and driven by a common power means. The power means drives alternate cylinders around the valve in phase and intermediate cylinders 180° out of phase. Air intake means through the rotary valve is fed into ports of opposite supercharger cylinders through a Y-shaped passage. Compressed air or a fuel mixture from the supercharger cylinders is fed through a passageway to the power cylinders in intake phase. If a four stroke cycle engine is involved, the passage may be Y-shaped connecting two supercharger cylinders to a single power cylinder. Otherwise, a pair of enlarged supercharger cylinders feed a pair of power cylinders to provide high pressure input in a two stroke cycle engine. A passageway through the rotary valve connects that power cylinder being exhausted to exhaust. Firing means are preferably provided in each cylinder and the cylinder ports are closed off by the rotary valve, except when confronted by passages. Fuel for combustion may be injected either in the passageway conveying compressed air from the supercharger cylinder into the power cylinder or within the power cylinder itself, for both spark ignition and compression ignition engine.

44 Claims, 32 Drawing Sheets

SUPERCHARGER
44
14
42
40
40
50d
104
28
38
102
99
48d
100
88
30d
97
98
10
2
2
94
34d
32
22
62b
96
86
18
92
26
60b
90
60d
54d
16
24
62d
56d
12
80
78
82
20
84
74
76
64d
54d
64b
54b
66
68
72
70

42
44
14
104
40
40
50a
50d
48d
38
28
48a
106
30d
10
5
5
102
97
99
88
100
98
94
91
92
34d
96
6
6
90
86
22
60a
62d
26
62a
58a
56a
60d
SUPERCHARGER
16
7
7
24
80
58d
54d
8
12
78
82
56d
8
20
74
84
64a
54d
84
54a
76
64d
68
66

FIG. 12 E GRAPHIC ILLUSTRATION OF ONE POWER CYLINDER FILLING FROM TWO SUPERCHARGER CYLINDERS THROUGH THE ROTARY VALVE
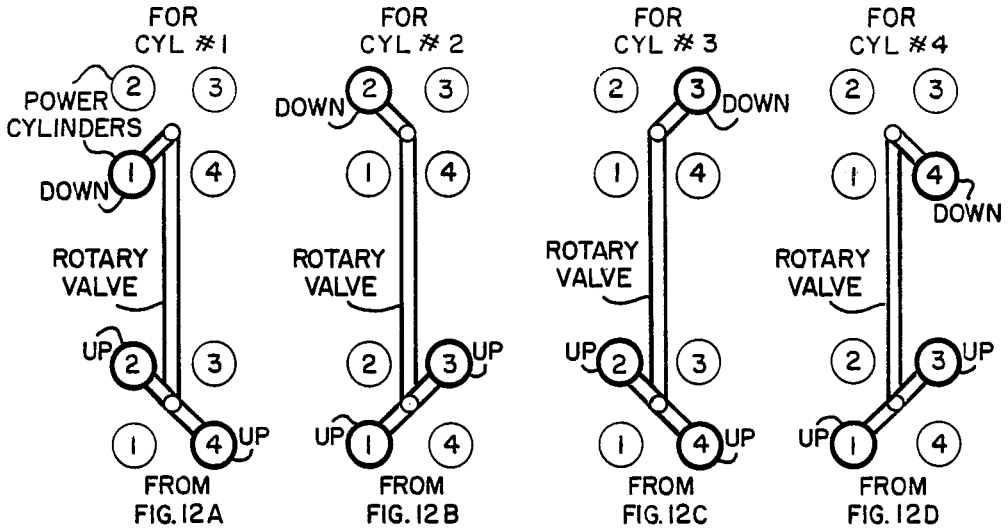
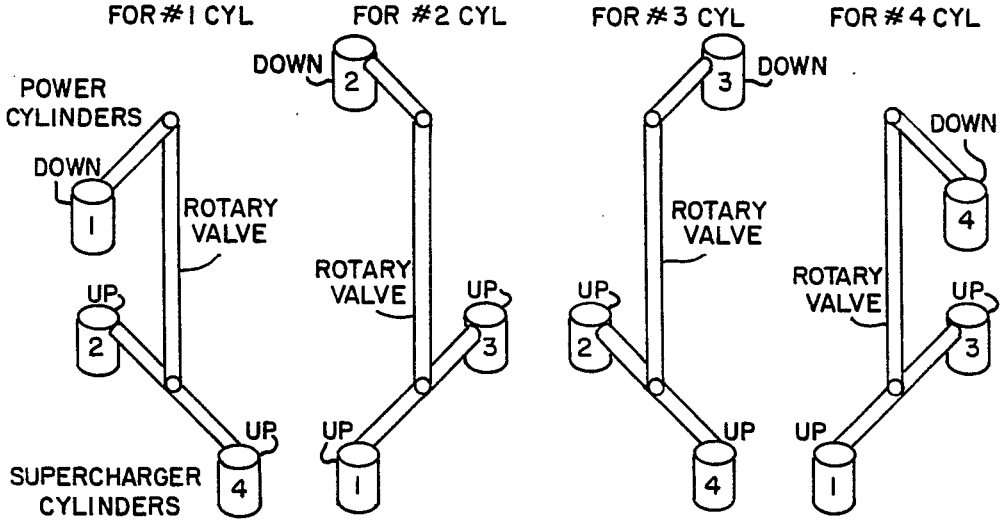

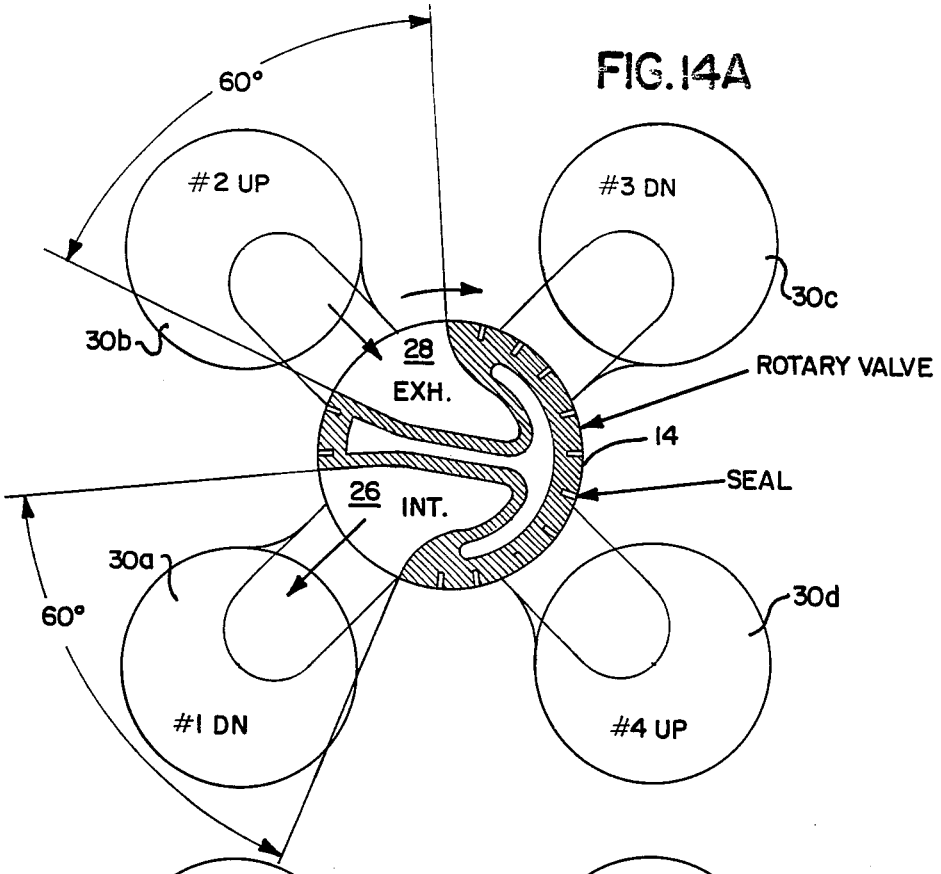
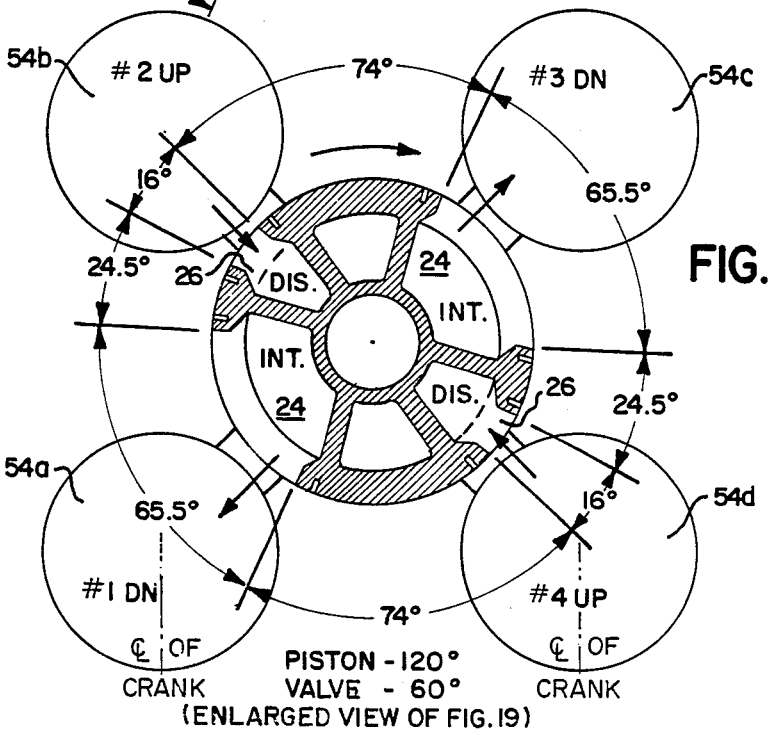
FIG. 14B
(ENLARGED VIEW OF FIG. 19)

CRANK ℄
CRANK ℄

#2 BDC
#3 TDC
#1 TDC
#4 BDC
#2 UP
#3 DN
#1 DN
#4 UP
EXH.
INT.
60°
30a
30b
30c
30d
14
24
26
28
54a
54b
54c
54d
1 & 3 PISTON - TDC
VALVE - 0°
PISTON - 30°
VALVE - 15°
PISTON - 60°
VALVE - 30°

PISTON - 90°
VALVE - 45°
PISTON - 120°
VALVE - 60°
PISTON - 150°
VALVE - 75°

CRANK
CRANK

#2 TDC
#3 BDC
#1 BDC
#4 TDC
#2 DN
#3 UP
#1 UP
#4 DN
EXH
INT
28
26
14
30a
30b
30c
30d
54a
54b
54c
54d
24
PISTON-180°
VALVE-90°
PISTON-210°
VALVE-105°
PISTON-240°
VALVE-120°

PISTON-270°
VALVE-135°
PISTON-300°
VALVE-150°
PISTON-330°
VALVE -165°

1 & 3 PISTON TDC-360°
VALVE-180°

PISTON-390°
VALVE-195°

PISTON-420°
VALVE-210°

PISTON-450°
VALVE-225°

PISTON-480°
VALVE-240°

PISTON-510°
VALVE-225°

CRANK ℄
CRANK ℄

#2 TDC
#3 BDC
#1 BDC
#4 TDC
#2 DN
#3 UP
#1 UP
#4 DN
INT
EXH
14
26
28
30a
30b
30c
30d
54a
54b
54c
54d
24
PISTON-540°
VALVE-270°
PISTON-570°
VALVE-285°
PISTON-600°
VALVE-300°

PISTON-630°
VALVE-315°
PISTON-660°
VALVE-330°
PISTON-690°
VALVE-345°

44'
14'
42'
40'
50a'
50d'
28'
37a
37d
30d'
39a
39d
41
41
14'
30a
35a
35d
34d'
42
42
88'
106'
34a'
26'
58d'
10'
10'
43
43
58a'
33a
54d'
SUPERCHARGER
54a'
56a'
24'
33d
56d'
12'
16'
74'
64d'
64d'

2 CYCLE TIMING FOR SPARK IGNITION ENGINES AND DIESEL ENGINES

PISTON - 160°
VALVE - 80°

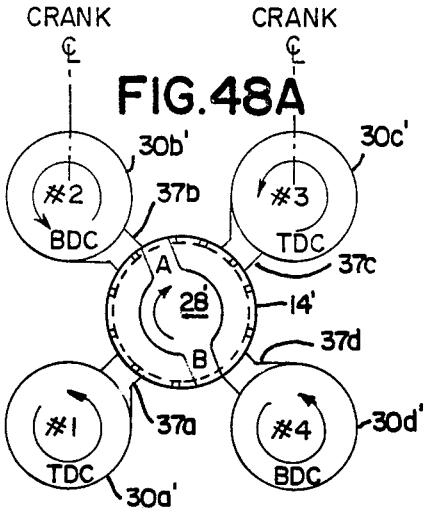
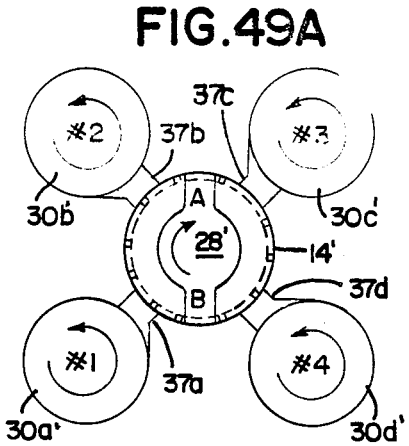
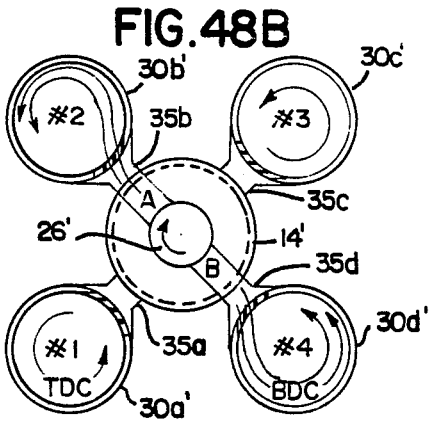
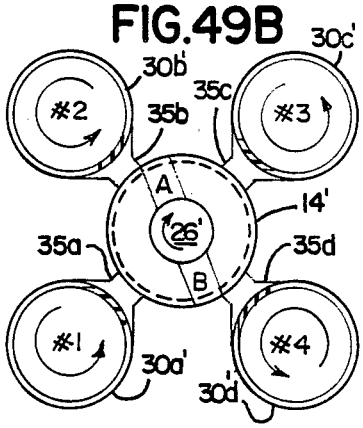
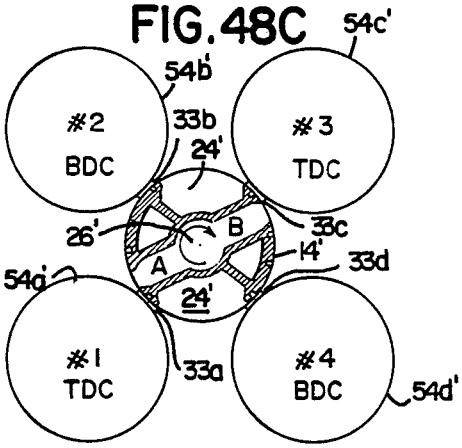
#1 & #3 PISTON—T.D.C.
VALVE — 0°
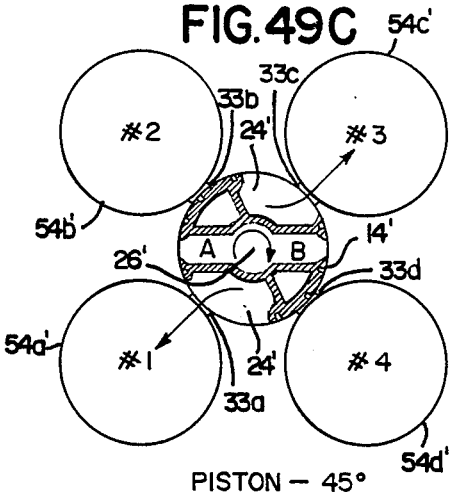
PISTON — 45°
VALVE — 22½°

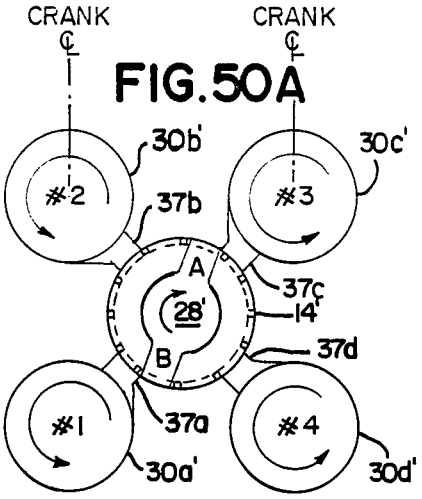
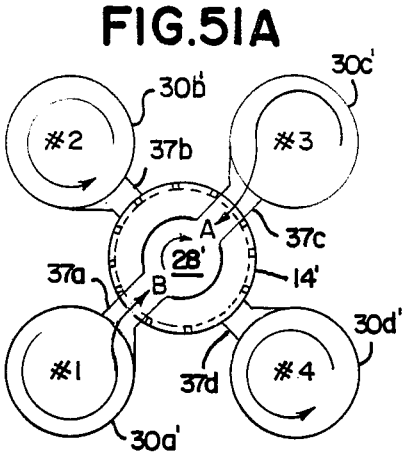
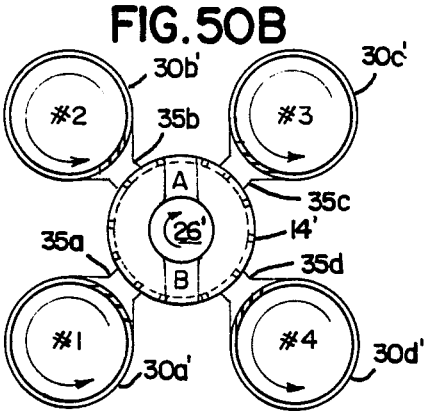
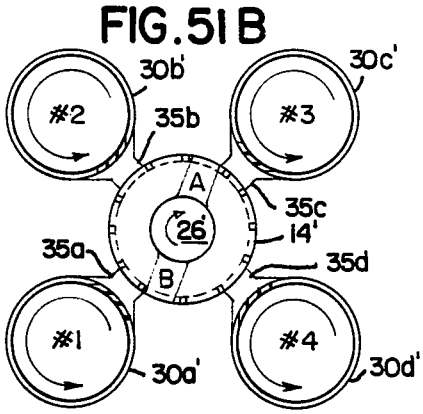
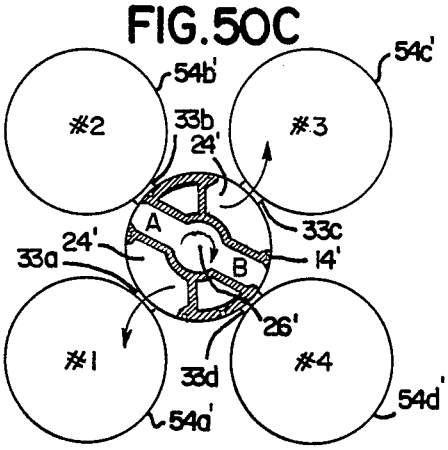
PISTON - 90°
VALVE - 45°
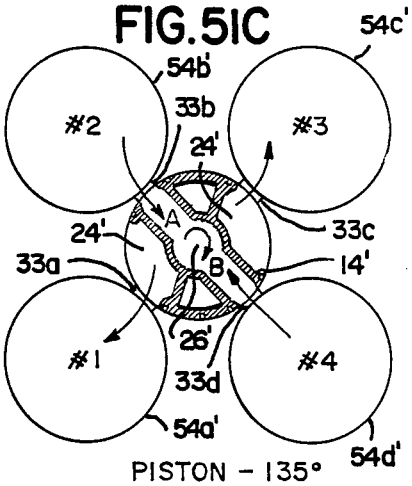
PISTON - 135°
VALVE - 67½°

FIG.58
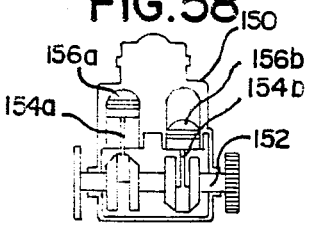
FIG.61
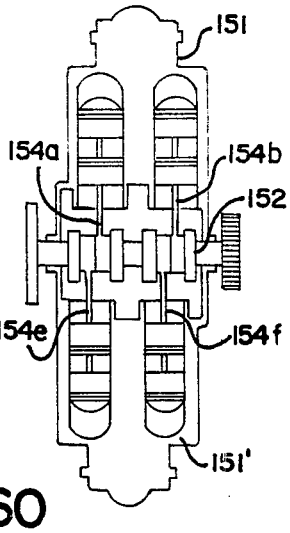
FIG.59
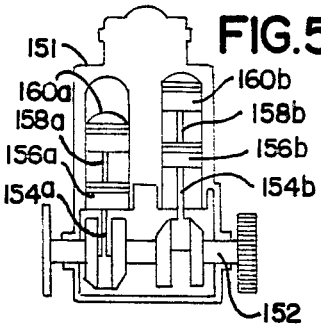
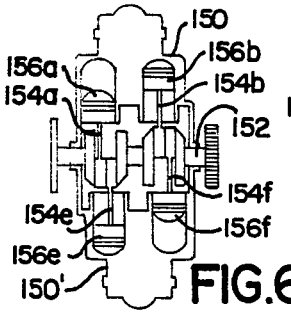
FIG.60
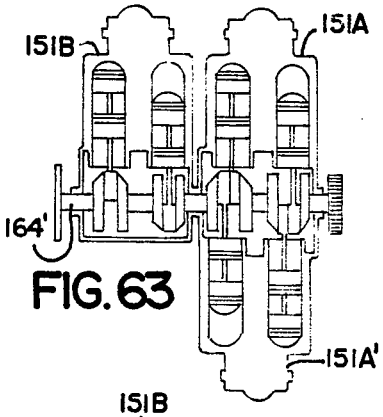
FIG.63
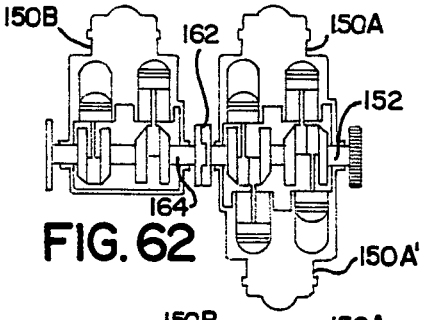
FIG.62
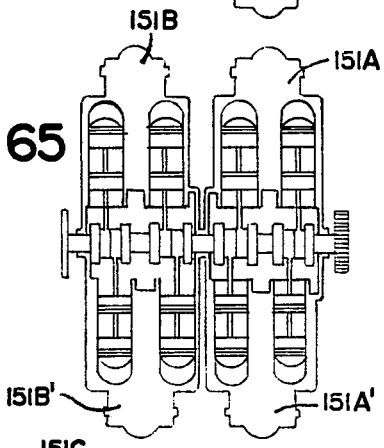
FIG.65
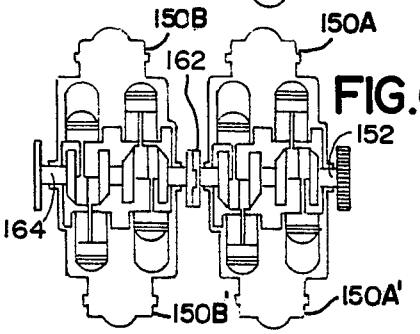
FIG.64
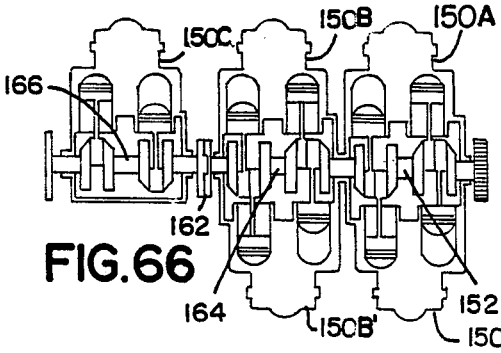
FIG.66
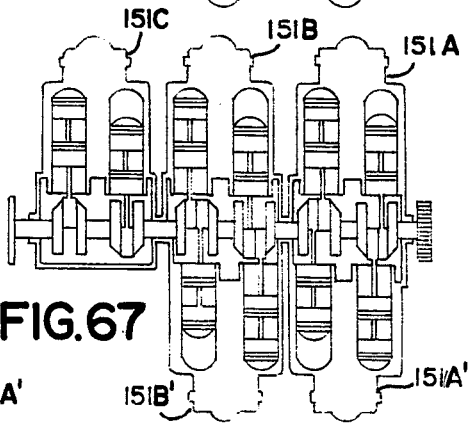
FIG.67

ROTARY VALVE ENGINE WITH TANDEM POWER AND SUPERCHARGER SECTIONS

BACKGROUND

The present invention relates to an engine configuration of the type described in the applicant's U.S. Pat. Nos. 4,392,460 and 4,444,161, with certain modifications. Much of the engine technology of the those patents and the applicant's U.S. Pat. No. 3,581,628 are applicable to the present invention and reference can be made to these patents for additional understanding of the invention.

SUMMARY OF THE INVENTION

The present invention is directed to the type of engine disclosed in the aforementioned patents which employs a plurality of cylinders clustered round a main rotary valve. One purpose of the present invention is to provide a supercharger for this type of engine which delivers more air to the cylinder to develop more power, and to improve scavenging of the cylinder. Another purpose for this supercharged rotary valve engine is to improve the efficiency of the typical high output internal combustion engine by utilizing the improved high efficiency of a piston type compressor for supplying the power cylinder combustion air. The piston compressor, unlike a centrifugal compressor, always supplies the right amount of air to the firing cylinders regardless of the engine speed. In other words, even at slow speed, the engine power cylinders are supercharged and the engine develops a much higher engine slow speed torque. The supercharger derives its advantage from the configuration of the rotary valve which allows supercharger or compressor cylinders to be placed axially in line with the power cylinders and effectively provides a cross head piston or a piston which is driven in tandem with the aligned power cylinder piston. Not only does the axially aligned supercharger cylinders' design provide great compactness and efficiency, but the combination of the basic engine and rotary valve without supercharger requires only simple modifications to the basic engine in order to permit conversion to a supercharged engine which will provide air at a significantly higher pressure to the power cylinders.

Supplying air at higher pressure to the power cylinders in order to develop more power and better engine torque characteristics may be accomplished in two ways. First, higher pressure may be achieved by using two of the supercharger cylinders to supply a single power cylinder. Such an arrangement works particularly well on a four cycle engine having a cluster of four power cylinders. Alternatively, the arrangement can provide greater volume in a single supercharger cylinder which feeds a single power cylinder in a two cycle engine. In this latter case, since the supercharger cylinders are axially in line with the power cylinders and the piston and the supercharger is a cross head piston moving with the power piston, the length of stroke of the piston in the power and supercharger cylinders is the same. Therefore, any increase in volume must be accomplished by increasing the diameter of the supercharger cylinder, i.e., the area of the piston. In either of the two ways, the system lends itself to a pressure regulating system associated with the rotary valve whereby a limit may be set to the supercharged air pressure provided to the power cylinder so that any excess air is automatically vented to the exhaust manifold or to a catalytic converter or to the atmosphere. Fuel injection into the rotary valve power cylinder air intake passage is still able to be accomplished as was done in the applicant's prior inventions.

More specifically, the present invention broadly relates to an engine having an engine or cylinder block means providing a plurality of power cylinders having parallel axes, each power cylinder having associated firing means. An equal number of supercharger cylinders in the engine or cylinder block means are respectively axially aligned with the power cylinders. A central bore through the engine or cylinder block means has an axis parallel to the cylinder axes. The central bore has ports into each power cylinder at a common axial level and ports into each supercharger cylinder at another common axial level, respectively, at the end of the cylinder remote from drive means. These ports preferably serve both as intake and exhaust ports into the bore of the cylinders. A rotary valve is rotatably supported by the engine or cylinder block means in the central bore. The rotary valve provides at least one passageway successively connecting ports of the supercharger cylinders to a source of air during the intake phase of those cylinders. At least one passageway through the rotary valve successively connects ports of each supercharger piston with ports of power cylinders to permit transfer of compressed air to the power cylinders on the intake stroke of the power cylinder. At least one passageway through the rotary valve connects ports of the power cylinders successively to the exhaust. The rotary valve also functions as a means of opening and closing the ports which time the intake and exhaust part of the cycle of the power cylinders. Drive means connects the pistons and the rotary valve producing reciprocation of the pistons in a predetermined phased sequence and rotation of the rotary valve at one half the crank shaft speed. At least a first pair of said power pistons are in phase and a second pair are 180° out of phase with said first pair. The rotary valve is phased so that air flows through at least one passageway to the supercharger cylinders in time to be delivered to the power piston during the intake phase. Its phasing also allows air compressed in the supercharger cylinders to be allowed to pass through at least one passageway into the power cylinders for intake during the intake phase. The phasing of the rotating valve also allows products of combustion to be exhausted from the power cylinder ports to the engine exhaust port during the exhaust phase.

The preferred embodiment provides a four cycle engine in the power section with a two cycle compressor for the supercharger. In this preferred embodiment, two of the supercharger cylinders are permitted to draw in air from their air intake ports as the pistons are on their down stroke. Then, as compression is completed in the supercharger cylinders, two of those cylinders are connected by a common passageway or port to a single power cylinder whose piston is on its downward intake stroke to receive the compressed air. Fuel is preferably sprayed in the rotary valve passage at this time in a gasoline engine. If a Diesel type of system is employed, the fuel is delivered at the proper time in the cylinder. A pressure regulating valve means may be provided through the engine or cylinder block and ports communications into the aforesaid common passageway to regulate the pressure of the air going into the power cylinder. An exhaust passage in the rotary valve is timed to discharge the exhaust gases from the cylinder as the power piston moves upward.

Cooling of each power piston is provided through coolant passageways in the cylinder block. A spray nozzle means sprays cooling oil onto the underide of the power piston and the cylinder walls. Provision is also made for this cooling oil to be drained to the oil pan.

The alternative type of engine is typically a two stroke cycle power engine wherein the engine function is completed from intake to exhaust within a single down and up motion of the power piston in the cylinder. For this type of operation, the output of only one supercharger cylinder feeds one power cylinder. The two supercharger piston deliveries are accomplished at the same time; they may or may not be intermingled. However, the intake passageway through the rotary valve functions in the same way, except the compressed air is delivered to the bottom of each power cylinder near the piston bottom dead center, and the exhaust passageway functions in the same way as previously described for a four cycle engine. In this case, however, the diameter of the supercharger cylinder is enlarged while in the four cycle case was preferably kept close to the same size as the power cylinder. Enlargement up to several times the area of the power cylinder is possible which allows high pressure, or a greater quantity of air, to be supplied from the supercharger.

For a better understanding of the present invention, reference is made to the accompanying drawings of preferred embodiments of engines in accordance with the present invention in which.

Figure 1:
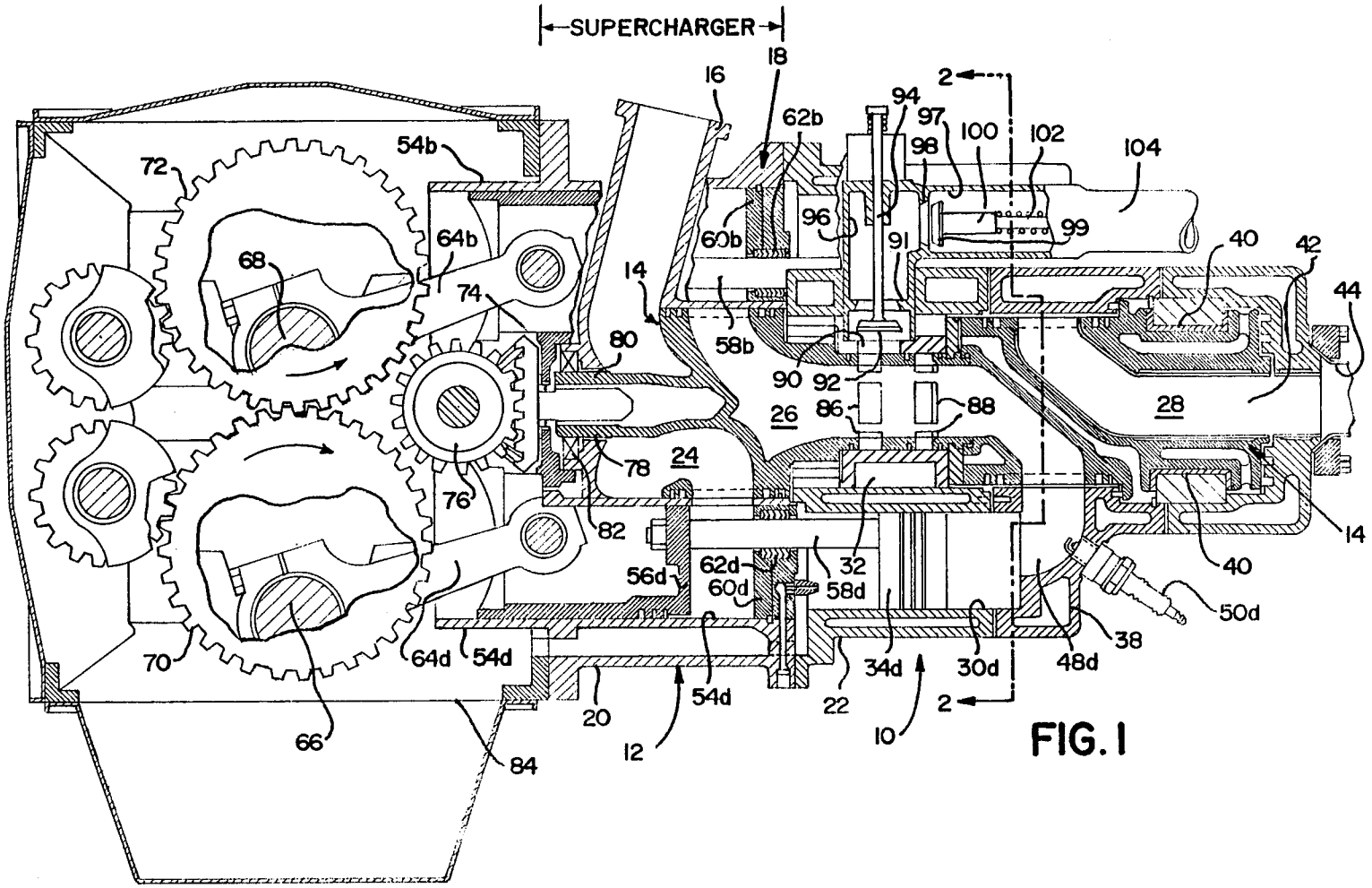
FIG. 1 is a longitudinal sectional view taken through the engine along line 1—1 of FIG. 2 of a four cycle engine shown in a horizontal orientation application.
Figure 1A:
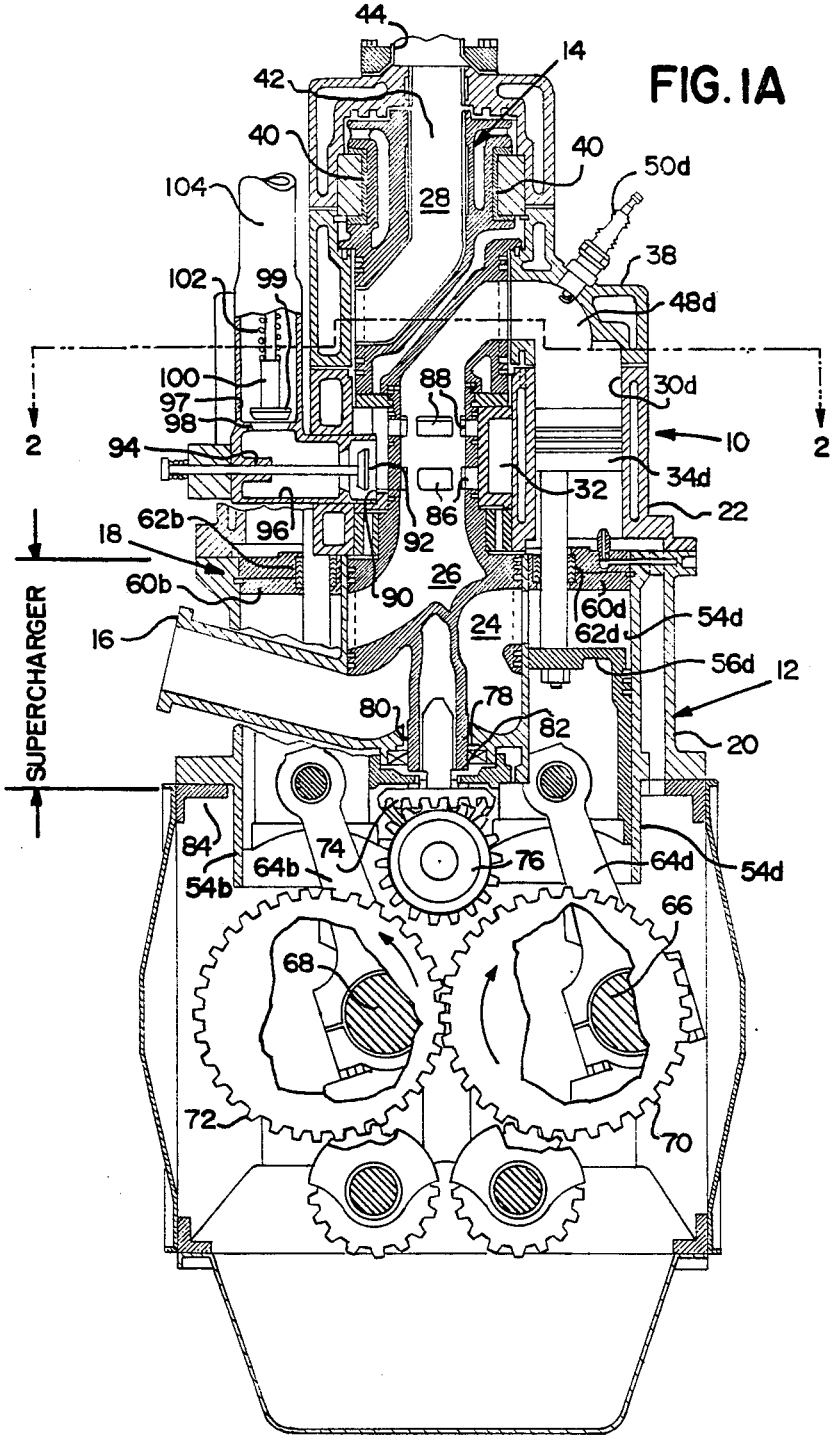
FIG. 1A is a sectional view through the same engine along line 1A—1A of FIG. 2 shown in a vertical orientation application.
Figure 5:
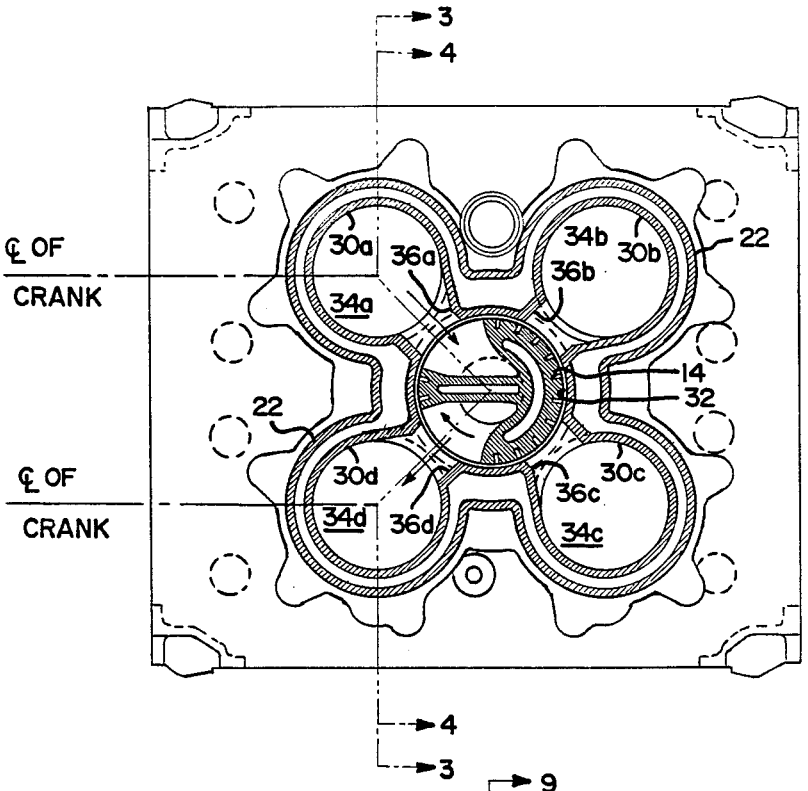
FIG. 5 is a cross-sectional view of the engine taken along line 5—5 of FIG. 4 through the cylinders and rotary valve.
Figure 7:
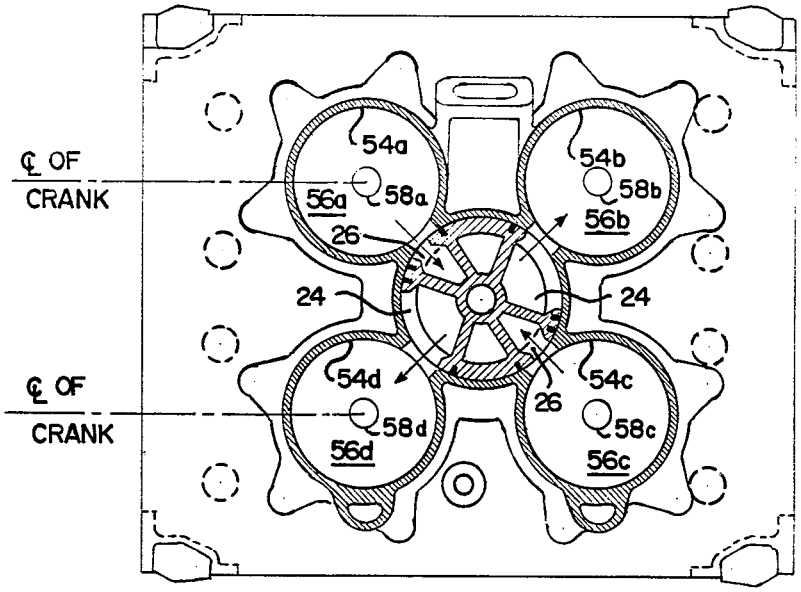
FIG. 7 is a cross-sectional view of the engine taken along line 7—7 of FIG. 4.
Figure 12:
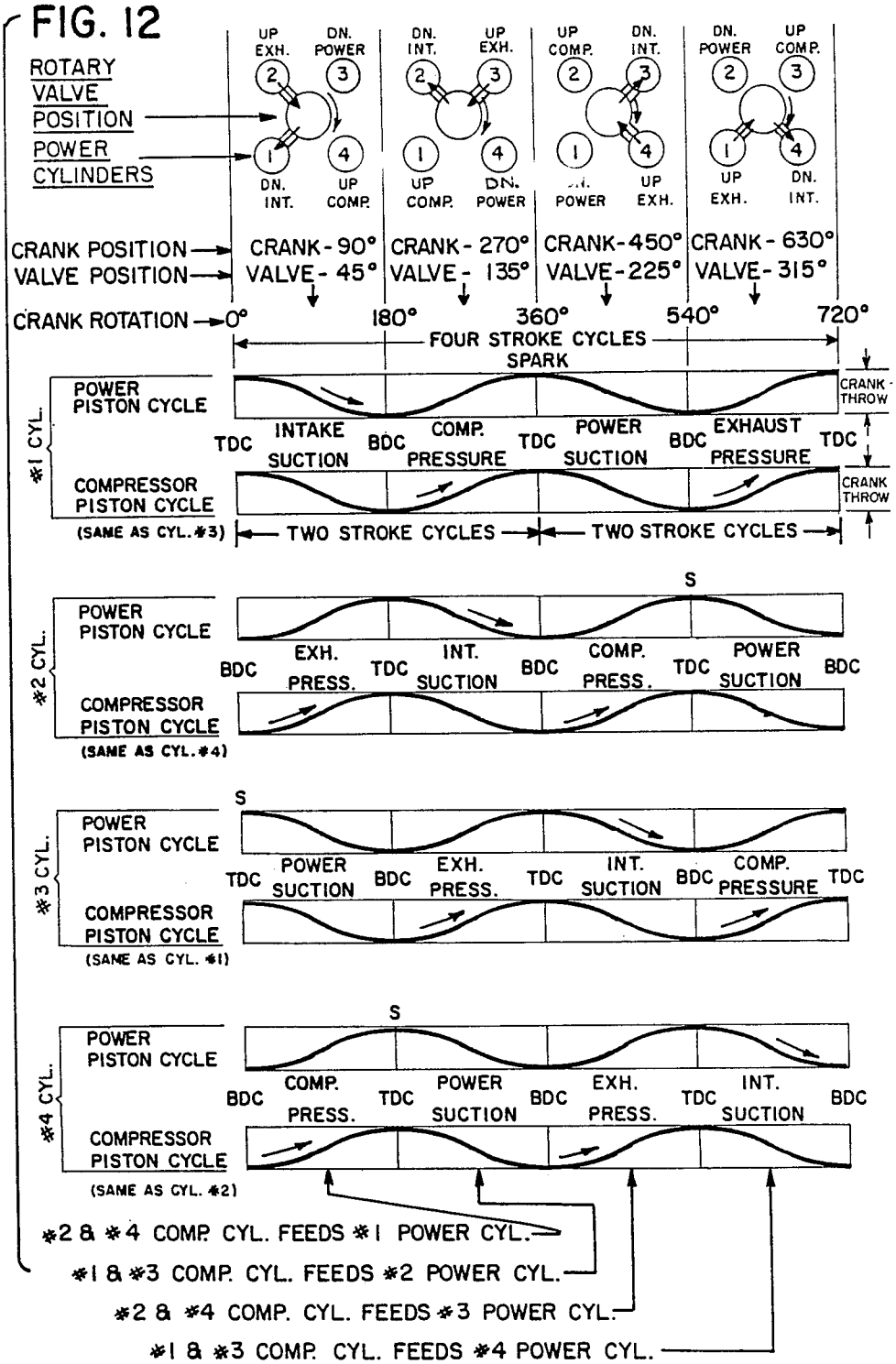
Figure 12A:
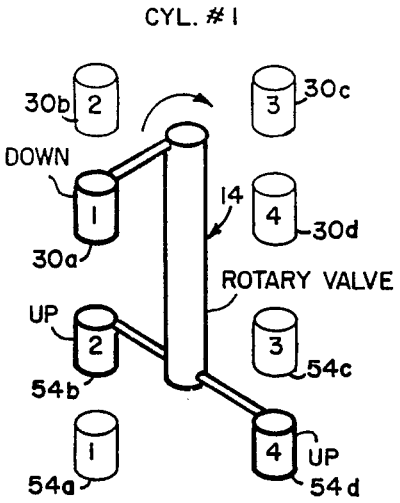
Figure 12B:
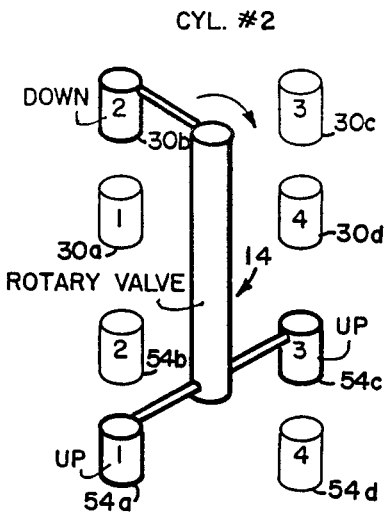
Figure 12C:
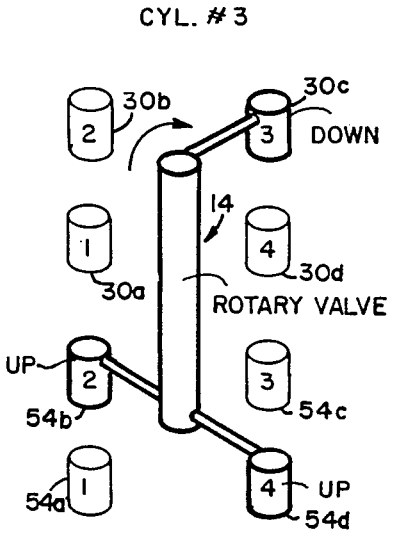
Figure 12D:
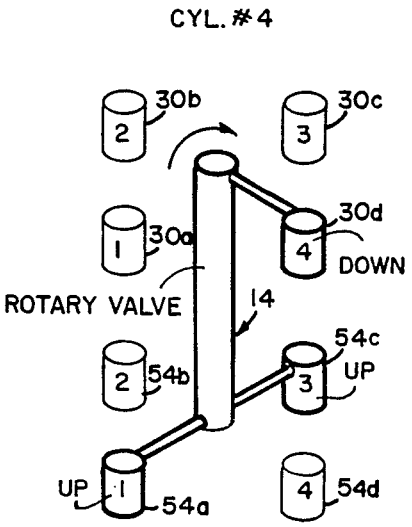
Figure 13A:
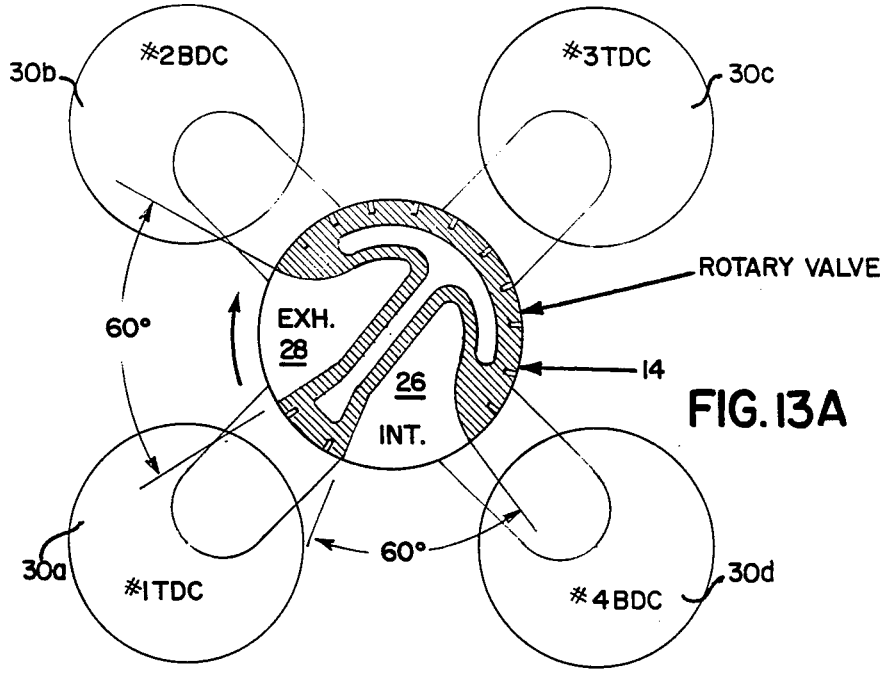
Figure 13B:
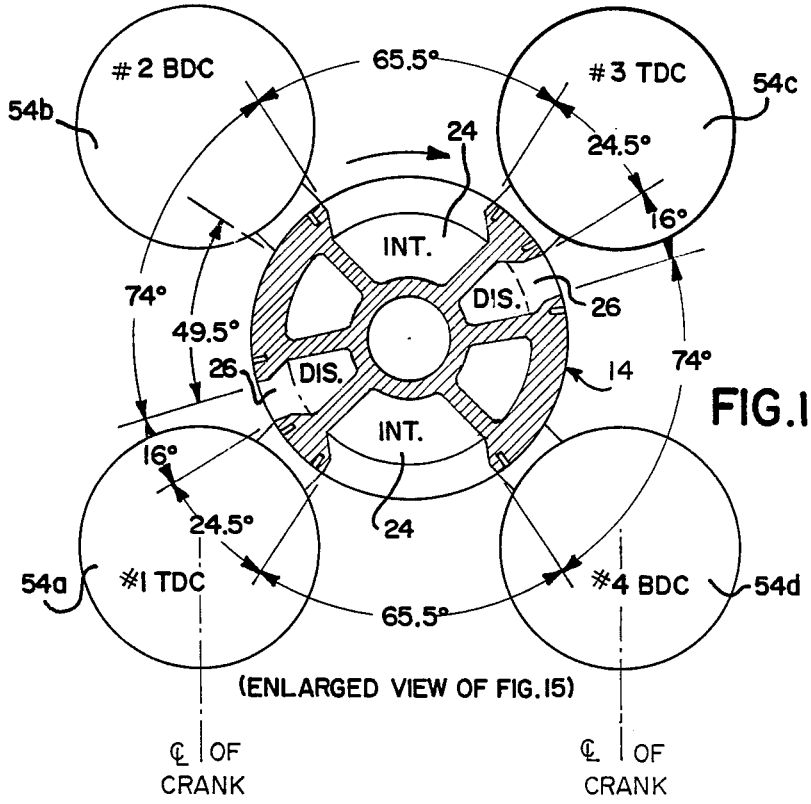
Figures 15, 16, 17, 18, 19, 20:
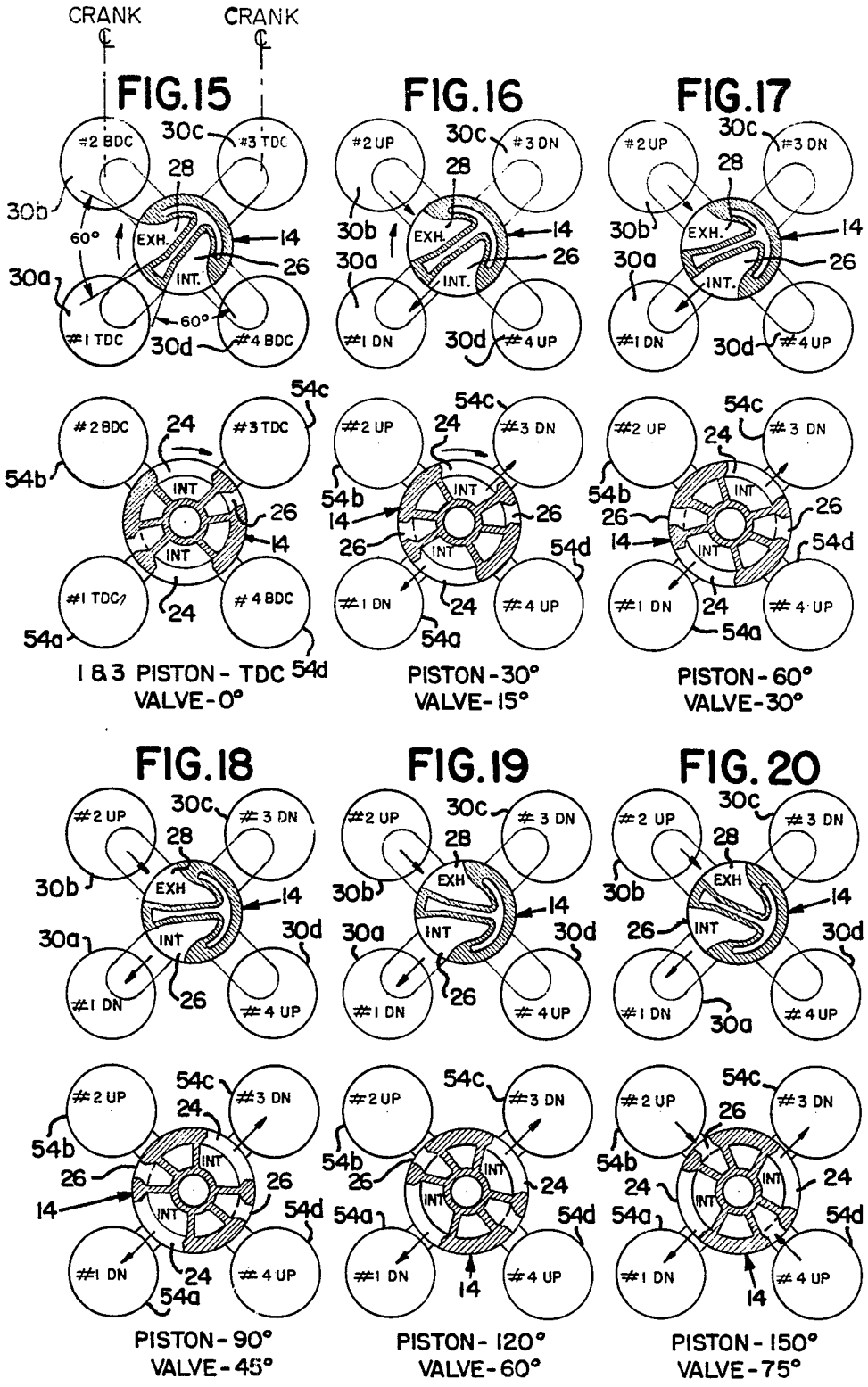
Figures 21, 22, 23, 24, 25, 26:
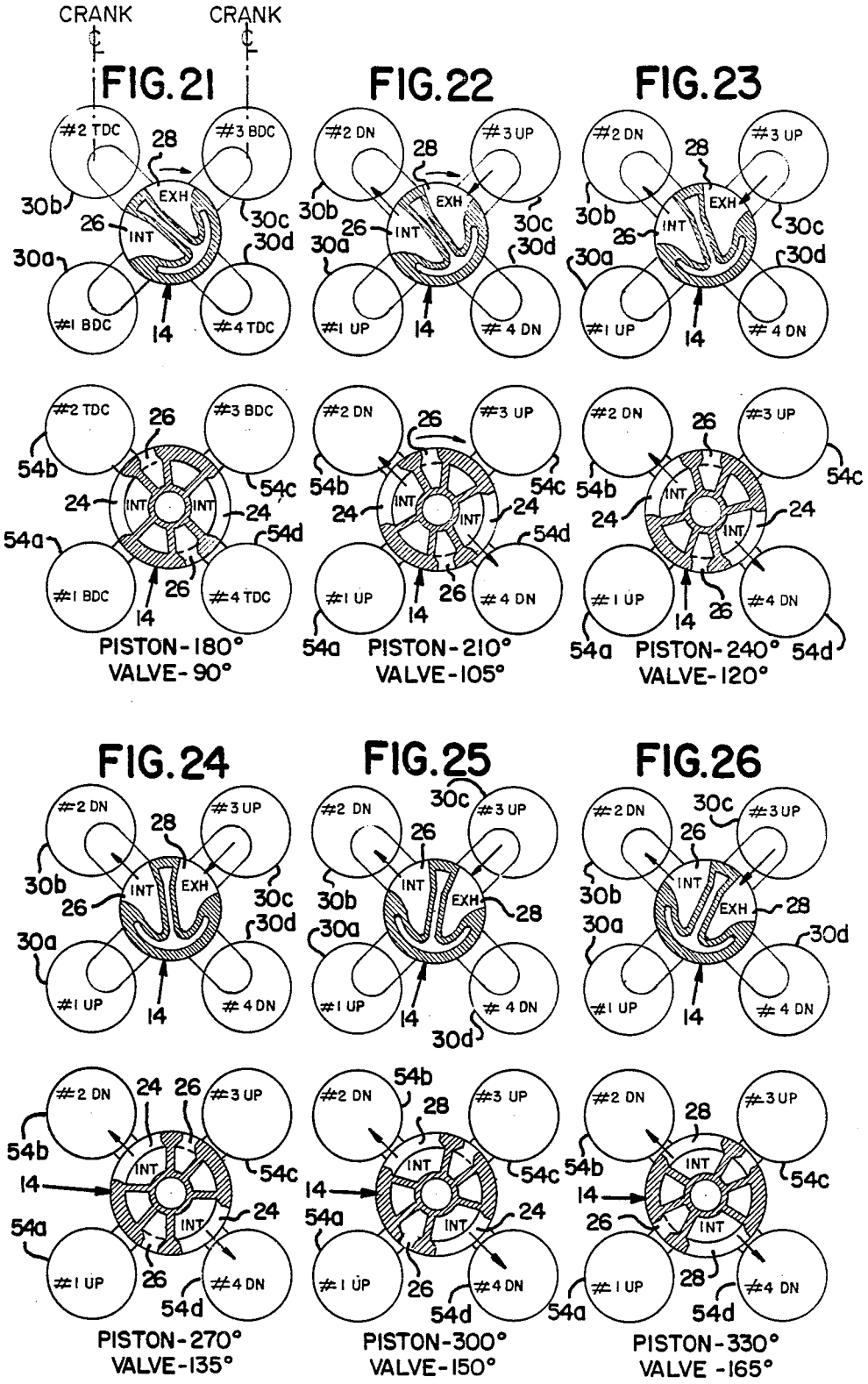
Figure 39:
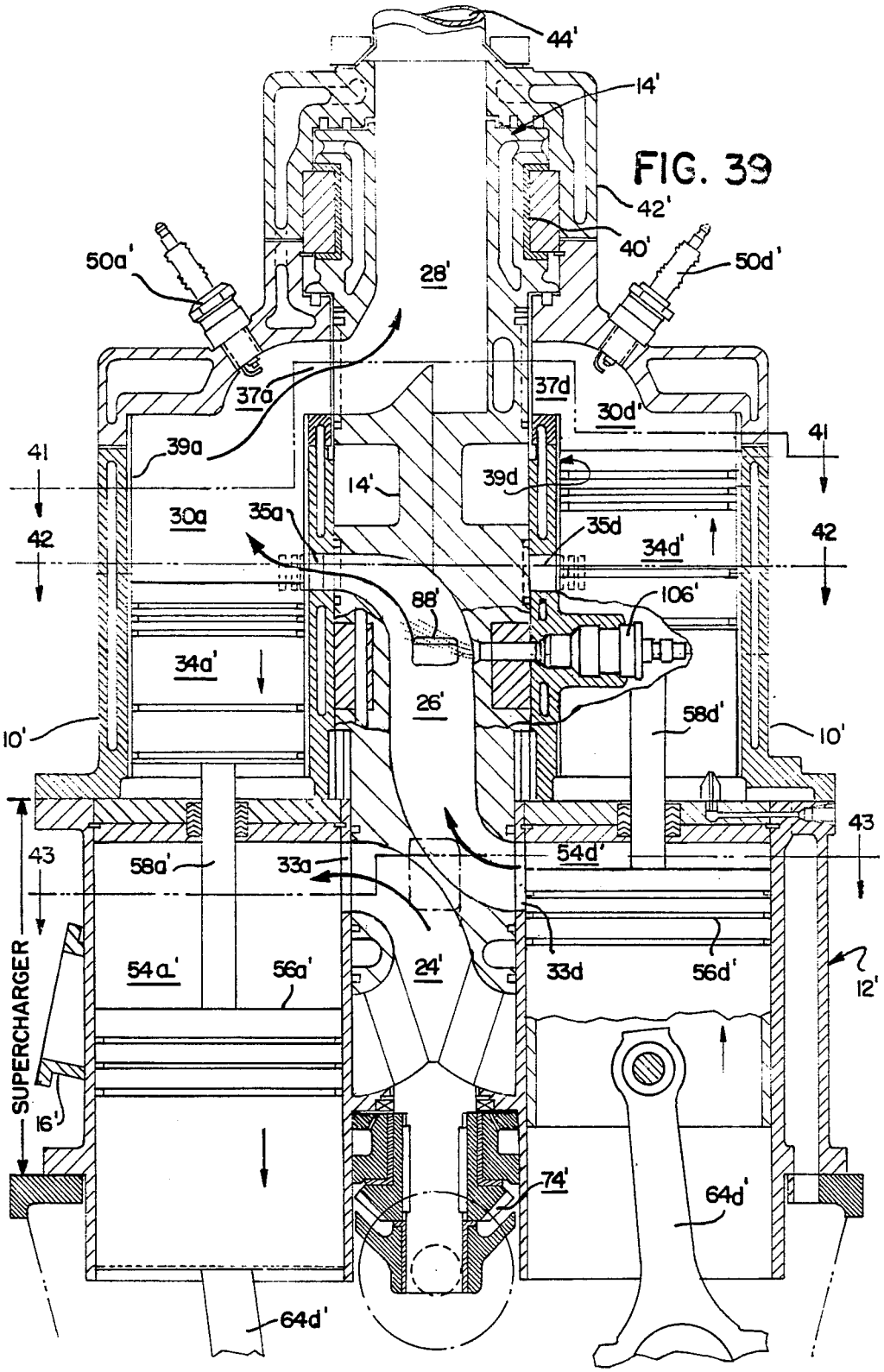
Figure 40:
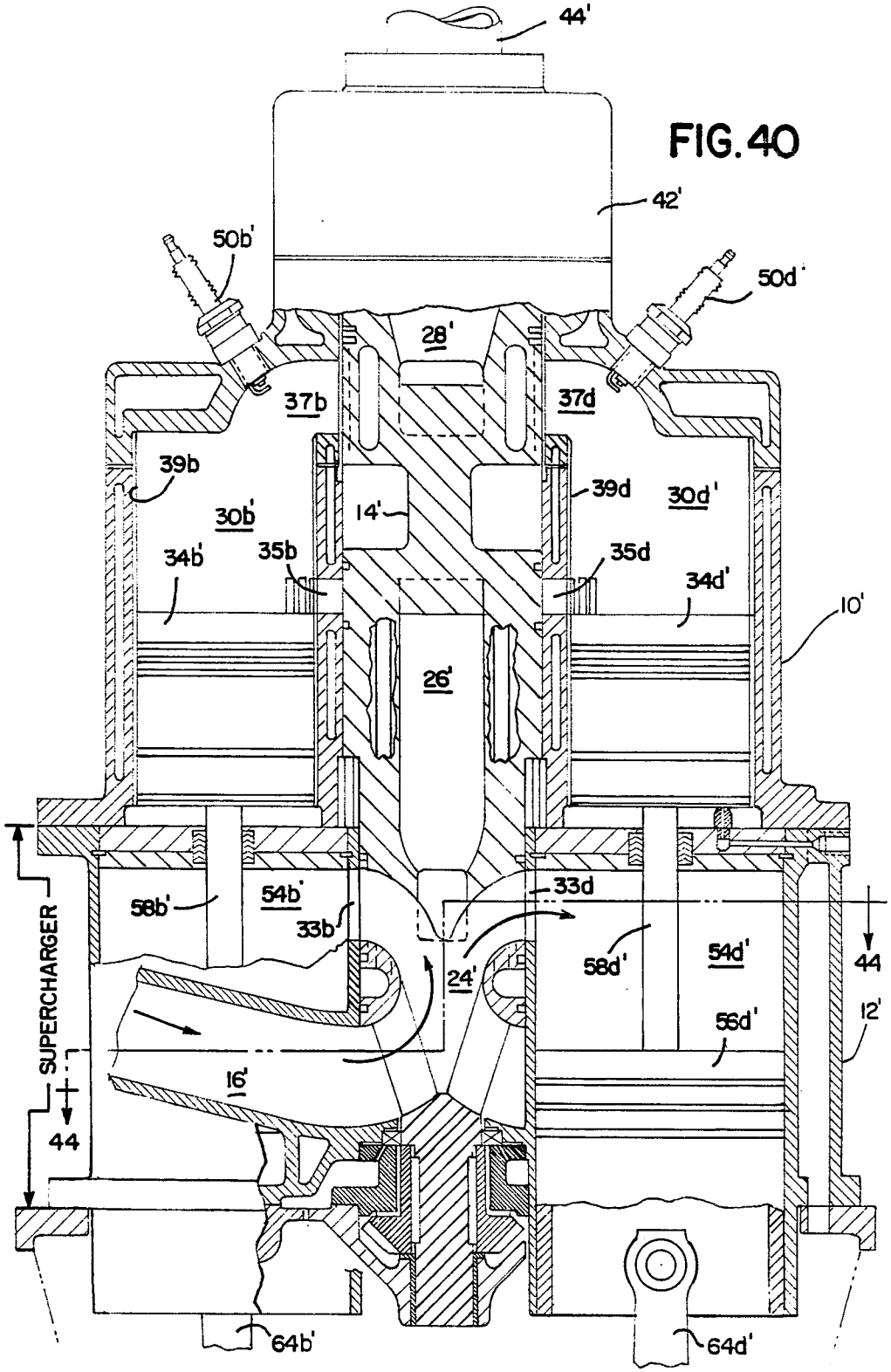
Figure 41:
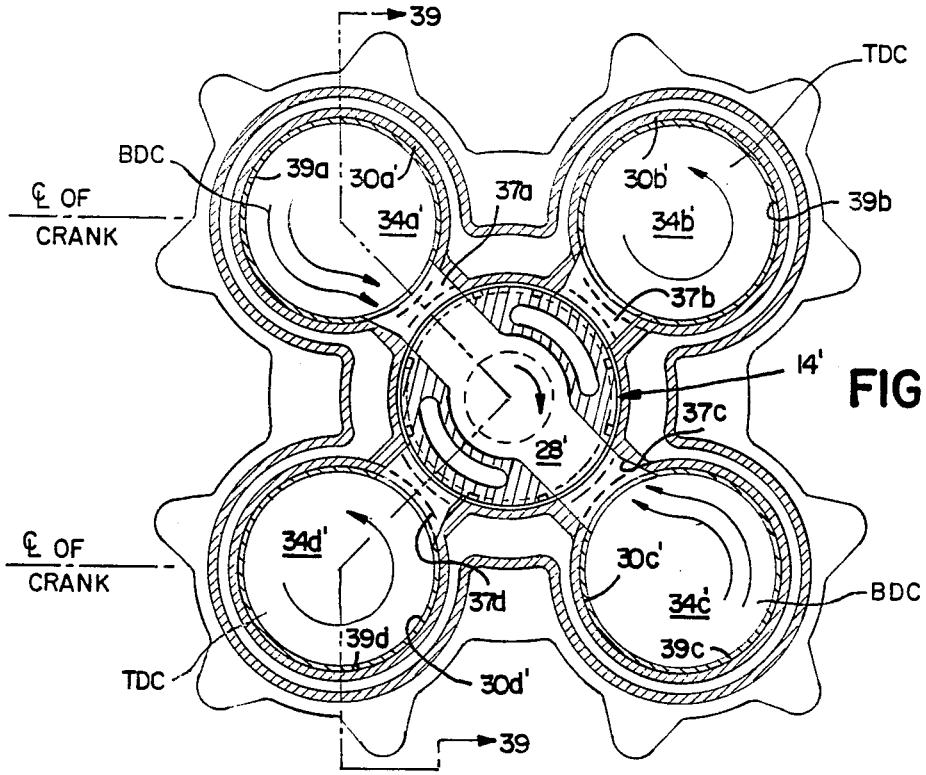
Figure 42:
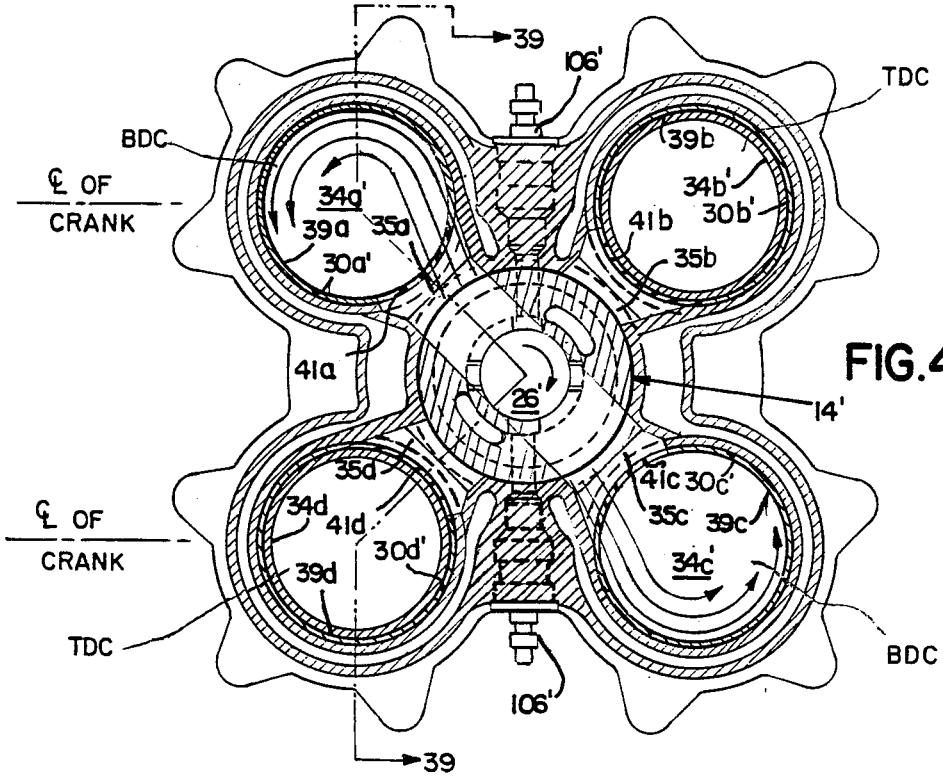
Figure 43:
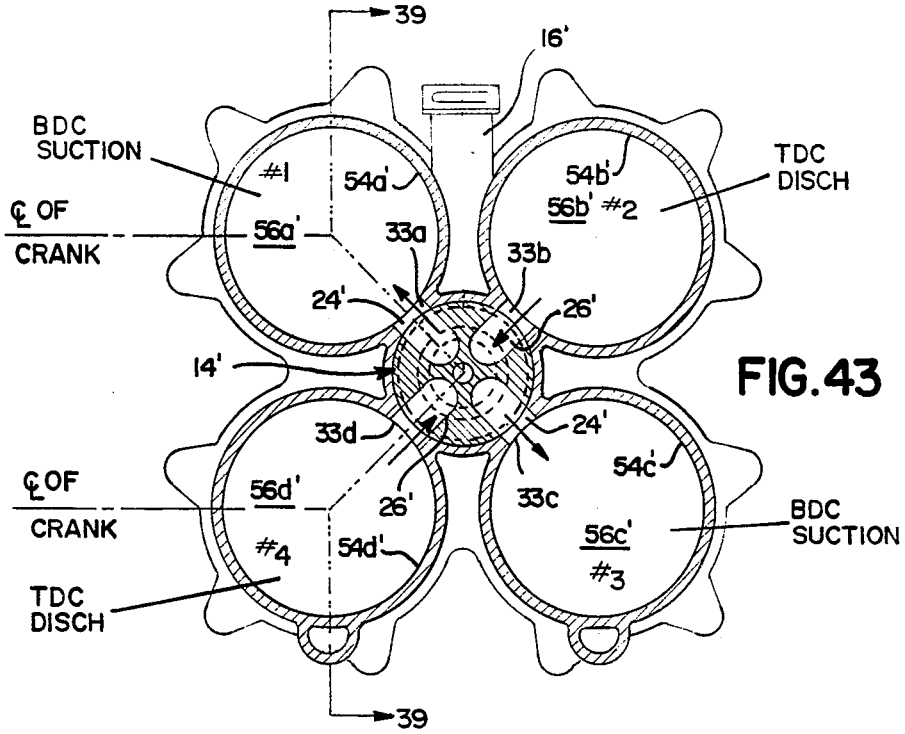
Figure 44:
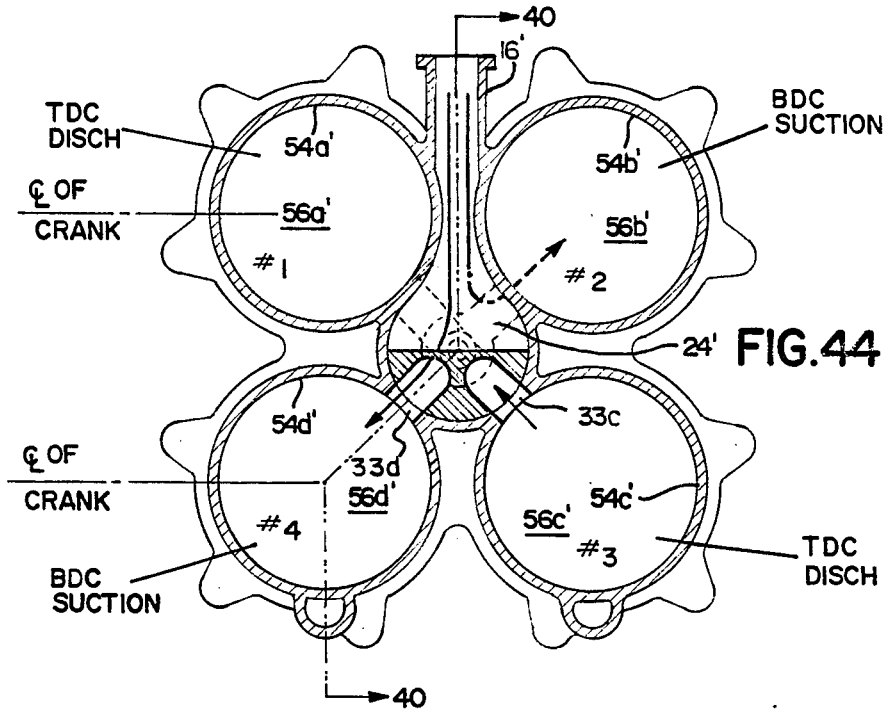
Figure 45:
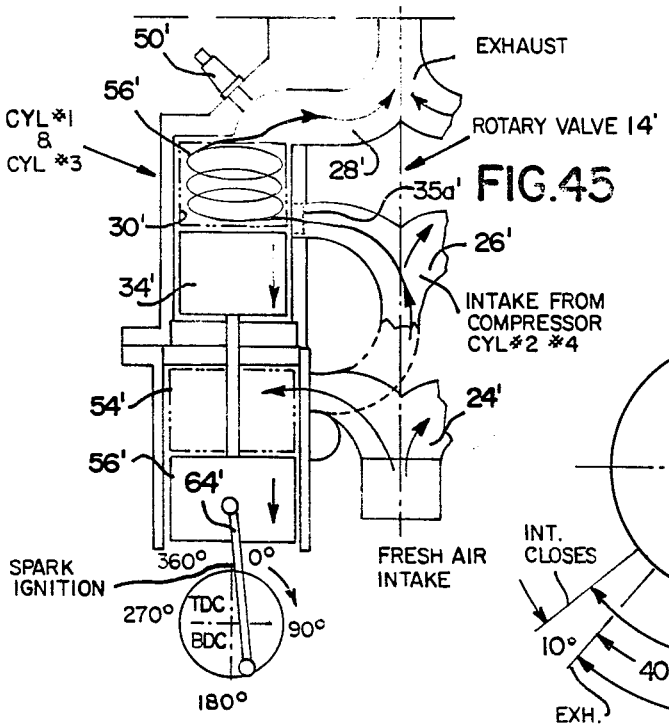
Figures 2, 45:
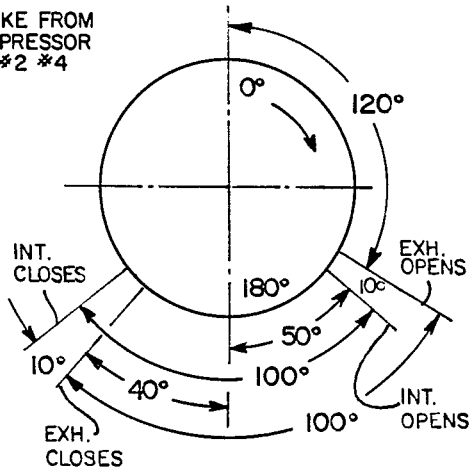
Figures 1, 45:
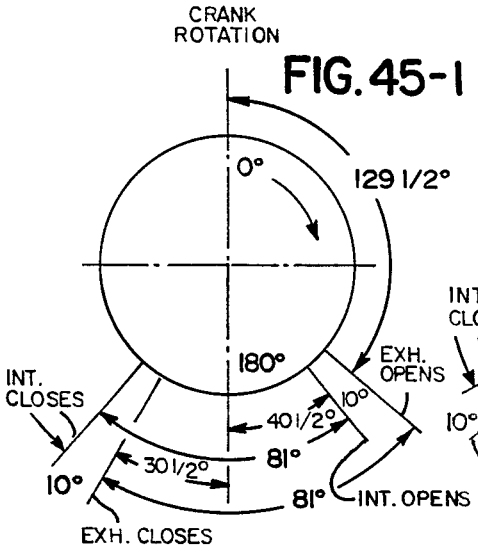
Figures 3, 45:
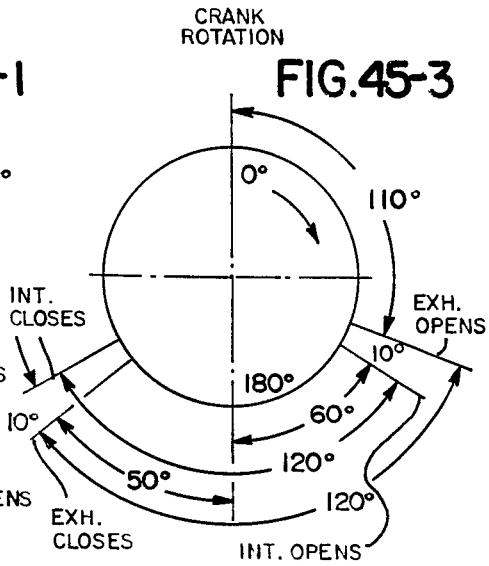
Figures 1, 46:
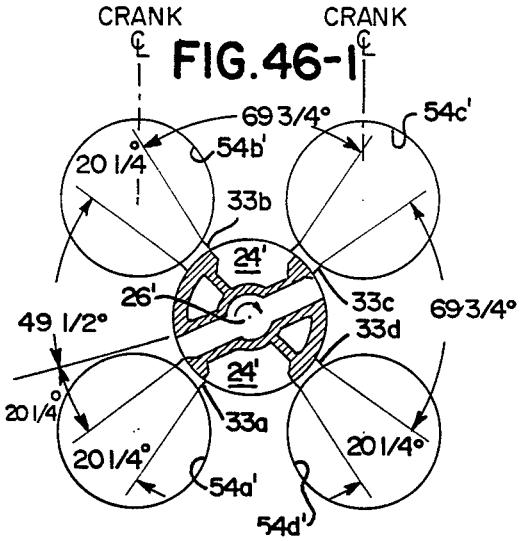
Figures 2, 46:
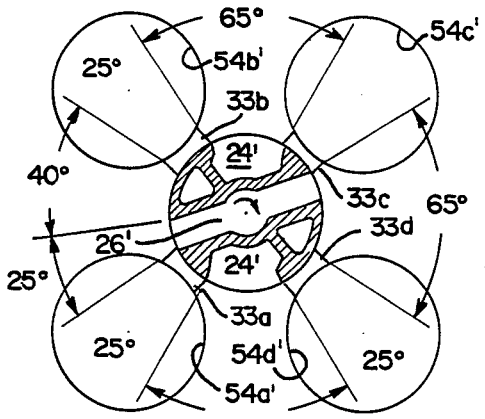
Figures 3, 46:
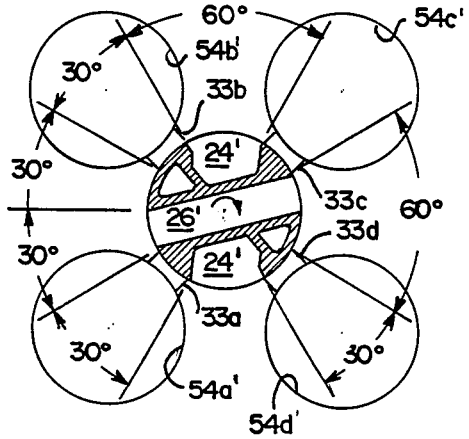
Figure 47A:
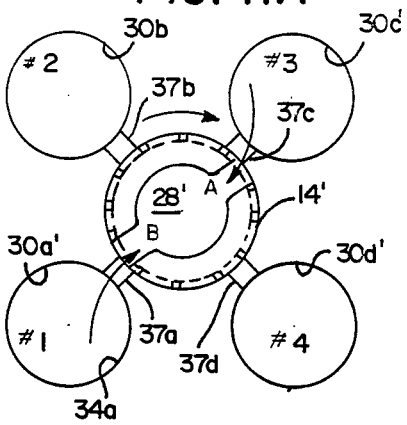
Figure 47B:
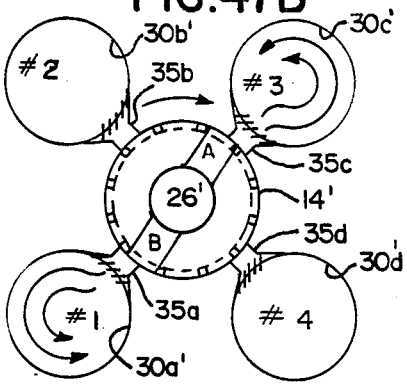
Figure 47C:
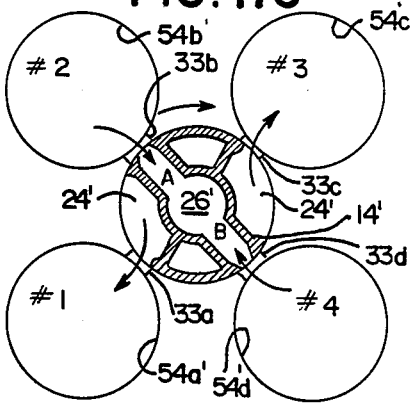
Figure 52A:
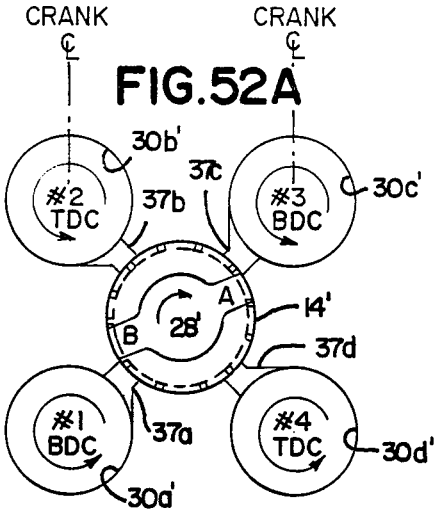
Figure 53A:
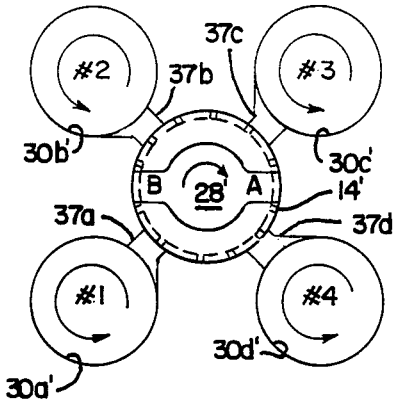
Figure 52B:
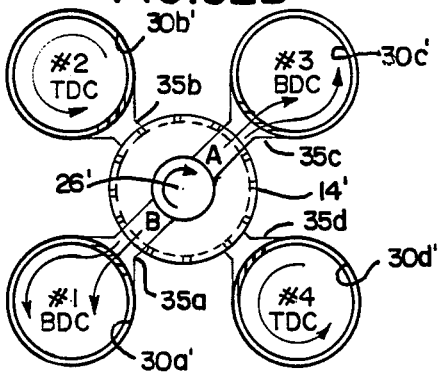
Figure 53B:
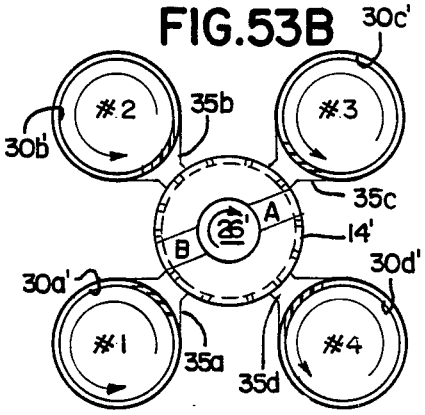
Figure 52C:
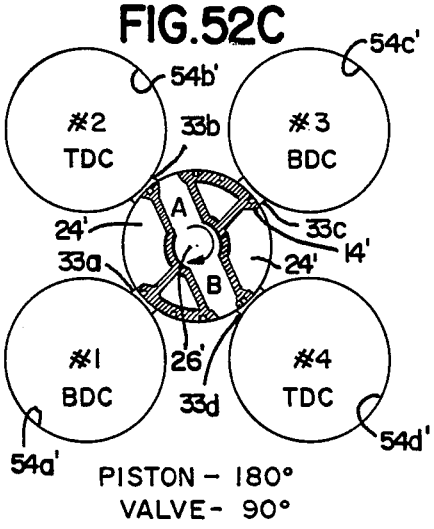
Figure 53C:
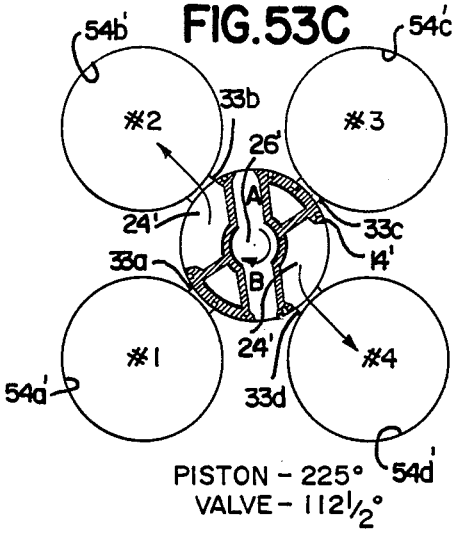
Figure 54:
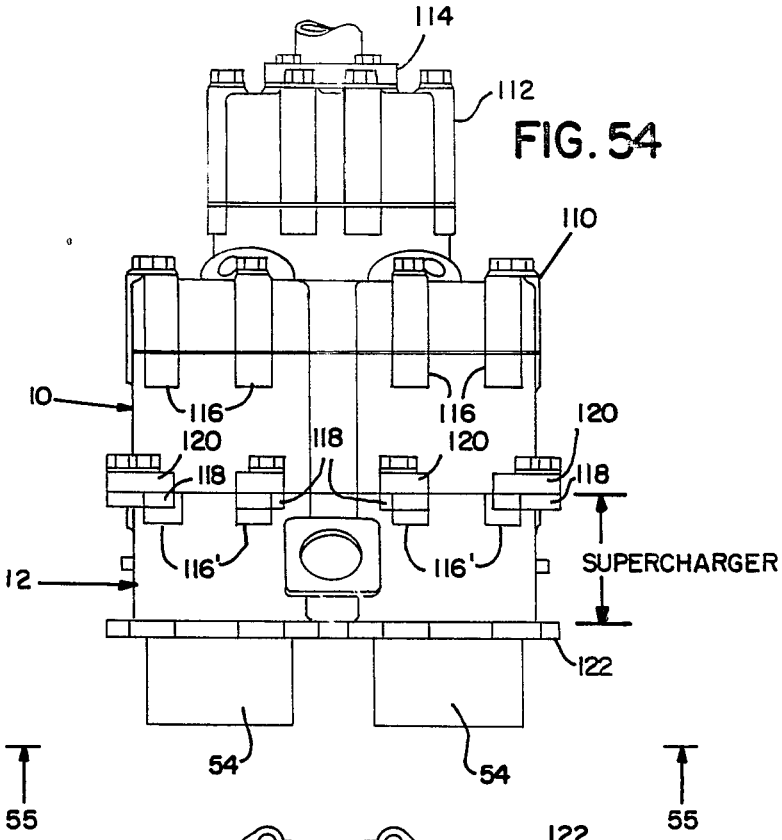
Figure 55:
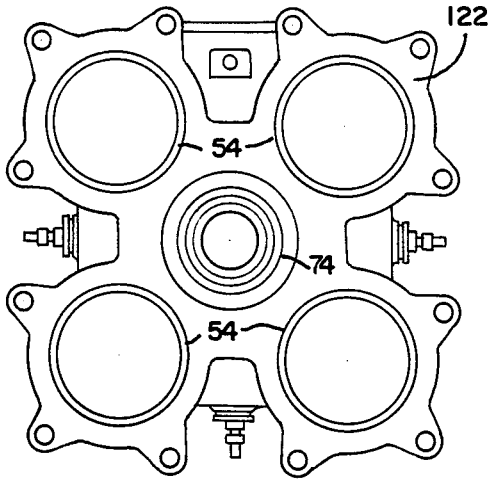
Figure 56A:
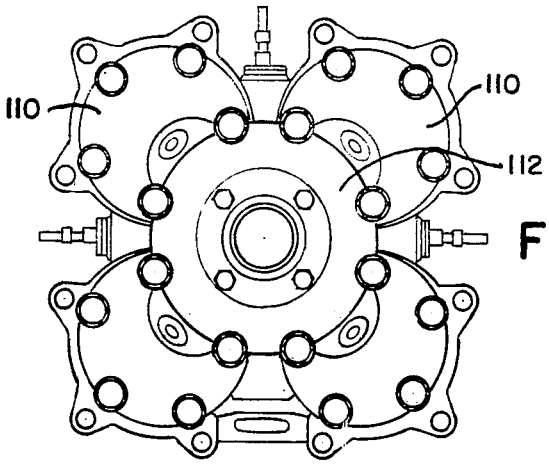
Figure 56B:
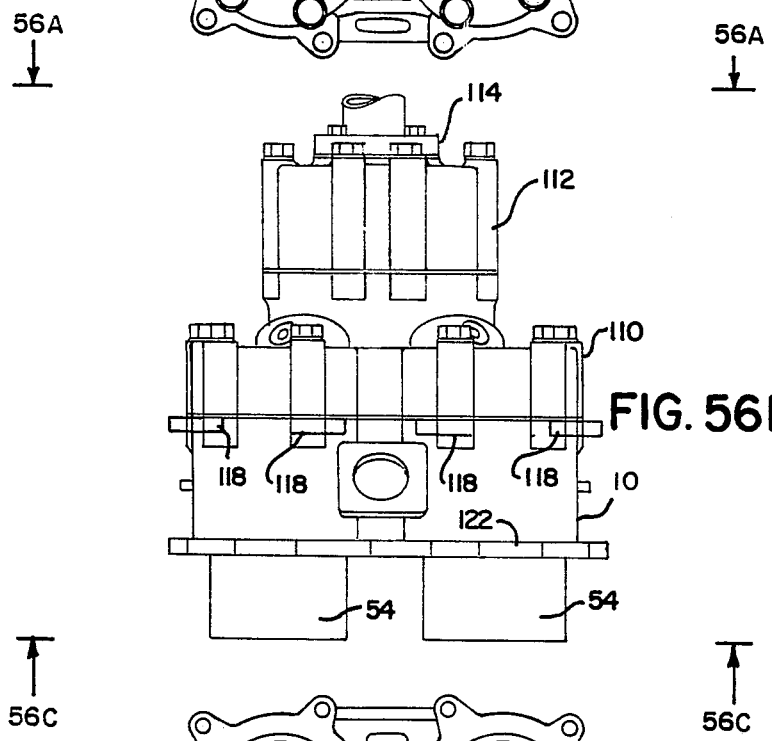
Figure 56C:
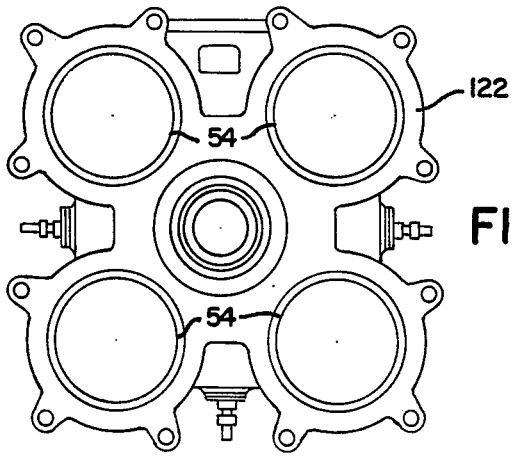
Figure 57:
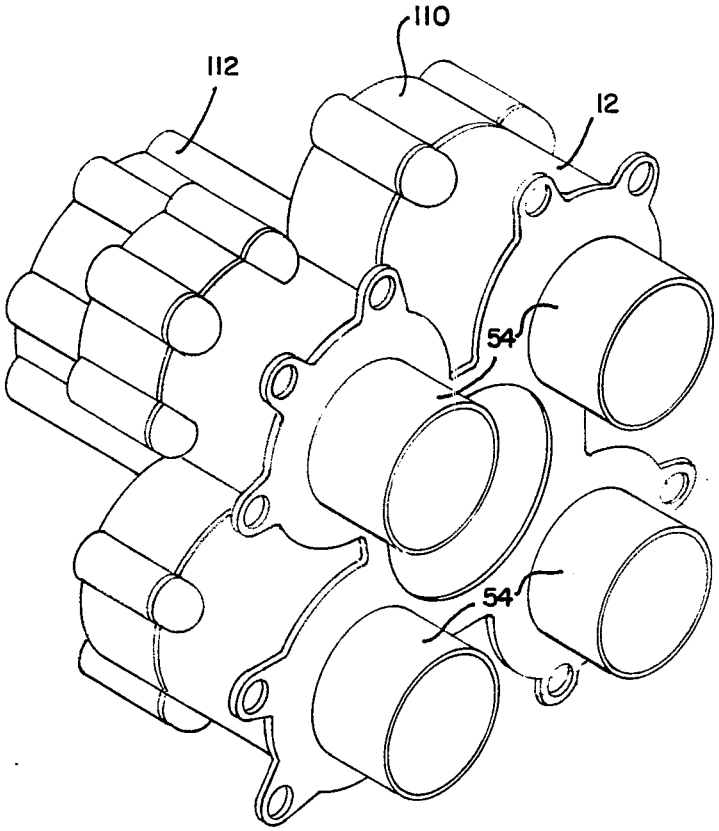

FIG. 12 provides diagrammatic charts with time related graphs showing the relative piston position of each piston in both the power and supercharger sections;

FIGS. 12A through 12D represent diagrammatically in perspective the relative cylinder interconnections through the rotary valve in successive 90° rotation positions of the valve;

FIG. 13A is a schematic view of the power cylinders (the enlarged top diagram of FIG. 15) similar to that of FIG. 5 but with the valve in a different position;

FIG. 13B is a schematic view of the supercharger cylinders (the bottom diagram of FIG. 15) enlarged similar to FIG. 7 but with the valve in a different position;

FIG. 14A and 14B are schematic views of power cylinder and supercharger cylinder and rotary valve similar to FIG. 13A and 13B but with the position of the rotary valve advanced 60°, corresponding to 120° rotation of the crank shafts, and FIG. 14A and 14B together are an enlarged view of FIG. 19;

FIGS. 15 through 38 are schematic views showing together the sequential positions of the rotary valve relative to the corresponding position of each power cylinder and the supercharger cylinder as the valve rotates 15° clockwise from the position of FIG. 15. The other figures are each 15° from the previous figure so that, taken together, the FIGS. represent one rotation of the valve (360°) and two entire rotations of the crank (720°);

FIG. 39 is an enlarged cross-sectional view similar to FIGS. 1 and 1A of another embodiment of the engine modified for two stroke cycle operation, taken along line 39—39 of FIGS. 41, 42 and 43;

FIG. 40 is a cross-sectional view of the two stroke cycle engine of FIG. 39 taken along line 40—40 in FIG. 44;

FIG. 41 is a cross-sectional view taken along line 41—41 in FIG. 39;

FIG. 42 is a cross-sectional view taken along line 42—42 in FIG. 39;

FIG. 43 is a cross-sectional view taken along line 43—43 in FIG. 39;

FIG. 44 is a cross-sectional view taken along line 44—44 in FIG. 40;

FIG. 45 is a diagramatic view in section through supercharger and a tandem power cylinder of the two cycle engine showing intake into each of the cylinders and exhaust from the power cylinder;

FIGS. 45-1, 45-2 and 45-3 are three diagramatic examples of intake and exhaust port rotary valve openings and closings at the power cylinder port level in one rotation of the crank shaft, illustrating variations possible in the valve design;

FIG. 46-1, 46-2 and 46-3 correspond to FIGS. 45-1, 45-2 and 45-3, respectively, showing variations possible in the design of the intake and exhaust port rotary valve openings and closings in conjunction with changes in cylinder port openings, taken at the level of the supercharger ports illustrating valve structure angles;

FIG. 47A is a schematic cross-sectional view at the level of the power cylinder exhaust ports;

FIG. 47B is a schematic cross-sectional view taken at the level of the power cylinder intake ports;

FIG. 47C is a view similar to FIG. 46 taken at the level of the supercharger ports with the valve structure in a different position corresponding to that of FIGS. 47A and 47B;

FIGS. 48A, 48B, 48C to FIGS. 53A, 53B, 53C are schematic cross-sectional views corresponding to those of FIGS. 47A, 47B and 47C, respectively, showing the rotating valve in different sequential positions as the valve rotates clockwise at intervals of 22½° as the crank rotates 45°;

FIG. 54 is an external elevational view of a module of the supercharged engine depicted in FIGS. 1–38;

FIG. 55 is a bottom view of a module taken along line 55—55 of FIG. 54;

FIG. 56A is an end view above either of the structures of FIG. 54 or FIG. 56B;

FIG. 56B is a side elevational view similar to FIG. 54 of an engine module employing only the power cylinders and not the supercharger cylinders;

FIG. 56C is a bottom view taken on line 56C—56C of FIG. 56B;

FIG. 57 is a perspective view of a standard non-suspercharged module employing only the power cylinders as shown in FIGS. 56A, 56B and 56C; and FIGS. 58 through 73 show how engine modules can be combined with similar modules in accordance with the present invention showing alternating composite structures with supercharged or non-supercharged engines.

Before referring to the drawings in detail, it should be understood that cross-sections taken in FIGS. 1, 1A, 4, 39 and 40, where step-ups and then step-downs are shown, are meant to indicate a rotational symmetry about the axis of rotation in the application of those steps.

Referring now to the figures in some detail, it will be observed that the power cylinder configuration and the use of the rotary valve was taught in the inventor's prior U.S. Pat. No. 4,392,460. The present invention is concerned with improvement on the aforesaid patented invention whereby a supercharger section is added to the power section of the engine. In fact, the supercharger derives its convenience from the use of in line cylinders in a supercharger section, the crosshead pistons of which, in effect, share common piston rods with the pistons of the power section. Crosshead pistons within the supercharger cylinders effect a precompression of air before it is fed to the cylinders of the power section. One rotary valve serves both sections and is redesigned to simultaneously direct the air for compression by two of the supercharger cylinders for the intake of a single power cylinder.

Referring now to the drawings, it will be seen that the power section, generally designated 10, lies axially above the supercharger section, generally designated 12, in the direction of flow. The common rotary valve, generally designated 14, extends through both the supercharger and the power sections. The rotary valve is provided with an air intake 16 which extends through the walls of the engine block 18. For convenience in repair functions, the engine or cylinder block may be subdivided into block sections, 20 for the supercharger and 22 for the engine. The rotary valve, as will be later described, has a Y-branched passageway 24 connecting the air intake to supercharger cylinders, two at a time in the preferred four cycle embodiment illustrated. The rotary valve has another Y-branched passageway 26, whose branches are intermediate to those of passageway 26 which connects the discharge of two of the supercharger cylinders with the intake of one of the power cylinders. The rotary valve has a power exhaust passageway 28 which is connected to the exhaust of one of the power cylinders at a time.

As seen in FIGS. 2 to 5, the power section has four cylinders 30*a*, 30*b*, 30*c* and 30*d* symmetrically arranged around the rotary valve 14 in central bore 32 of the engine or cylinder block section 22. The identical cylinders 30*a*, 30*b*, 30*c* and 30*d* contain identical pistons 34*a*, 34*b*, 34*c* and 34*d*. Closing the top of each of the cylinders is a common cylinder head 38 which is bolted to the engine or cylinder block 22 and provides bearing means 40 for rotatably supporting the valve and providing an axially aligned exhaust passage, aligned with the valve's exhaust passage 28 and, in turn, aligned with added exhaust pipe connection 44 connected to the head.

The head also provides each of the cylinders with an intake and exhaust duct 48*a*, 48*b*, 48*c* and 48*d* which is functionally shaped to direct the intake into the cylinders. Each duct effectively contains the compressed gases for firing the particular spark plug 50*a*, 50*b*, 50*c* and 50*d* located in the duct as shown in each of the power cylinders. The rotary valve 14 is also supported within power cylinder block section 22 by needle bearings 52 in FIG. 10. In each case, it will be understood, of course, that the bearings are provided with suitable bearing raceways and cages, if desirable, so that the bearings are not only confined but, in effect, prevent axial movement of the rotary valve while at the same time assuring the valve's smooth rotation.

The various sections of the engine are in actuality designed in modular form in order to permit removal and substitution of identically made parts rather than all of an engine. Modular form also permits the modules to be assembled in different ways giving greater variety to possible structures and minimizing the stocking of different parts.

It will also be understood that seals are employed between the various modular sections, such as between the rotary valve and the block or head portions with which it cooperates. The seals confine flow leakage.

Figure 8:
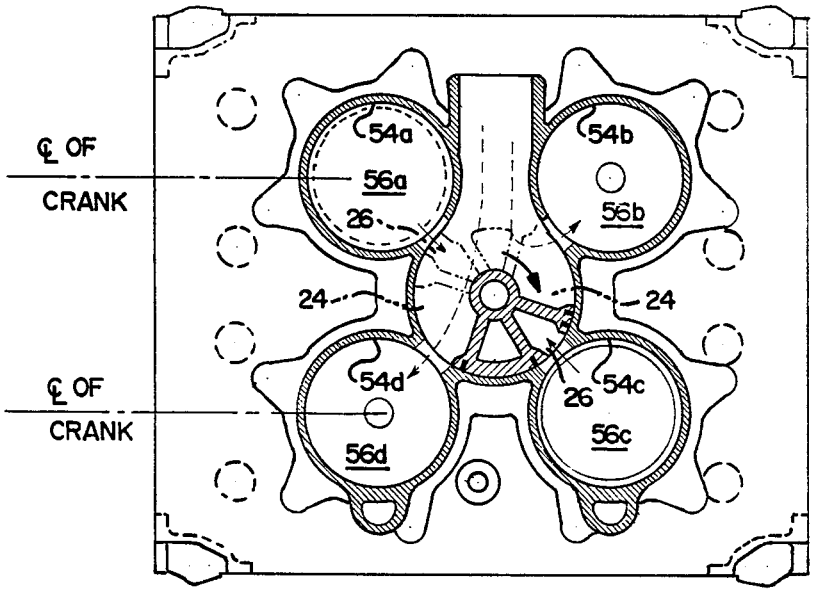
FIG. 8 is a cross-sectional view of the engine taken along line 8—8 of FIG. 4.

The supercharger cross-section, as best seen in FIGS. 7 and 8, is quite similar to the power section. The supercharger section has four cylinders 54*a*, 54*b*, 54*c* and 54*d*. Each cylinder contains a crosshead piston 56*a*, 56*b*, 56*c*, 56*d*. As seen in FIGS. 1, 1A, 3 and 4, the crosshead pistons are aligned and interconnected with power pistons 34*a*, 34*b*, 34*c* and 34*d* by piston rods 58*a*, 58*b*, 58*c* and 58*d*. Each of these rods passes through the crosshead top guide holding plate and cylinder head regions 60*a*, 60*b*, 60*c* and 60*d* through packings 62*a*, 62*b*, 62*c* and 62*d*, respectively. The pistons thus rigidly connected together, move up and down in synchronism in their axially aligned cylinders. Driving each of the supercharger pistons is a connecting rod 64*a*, 64*b*, 64*c* and 64*d*, and crank 66 and 68. Connecting rods 64*c* and 64*d* are rotatably and eccentrically connected to a common crank shaft 66 and with throws are 180° out of phase. Connecting rods 64*a* and 64*b* are similarly connected to crank shaft 68.

Figure 3:
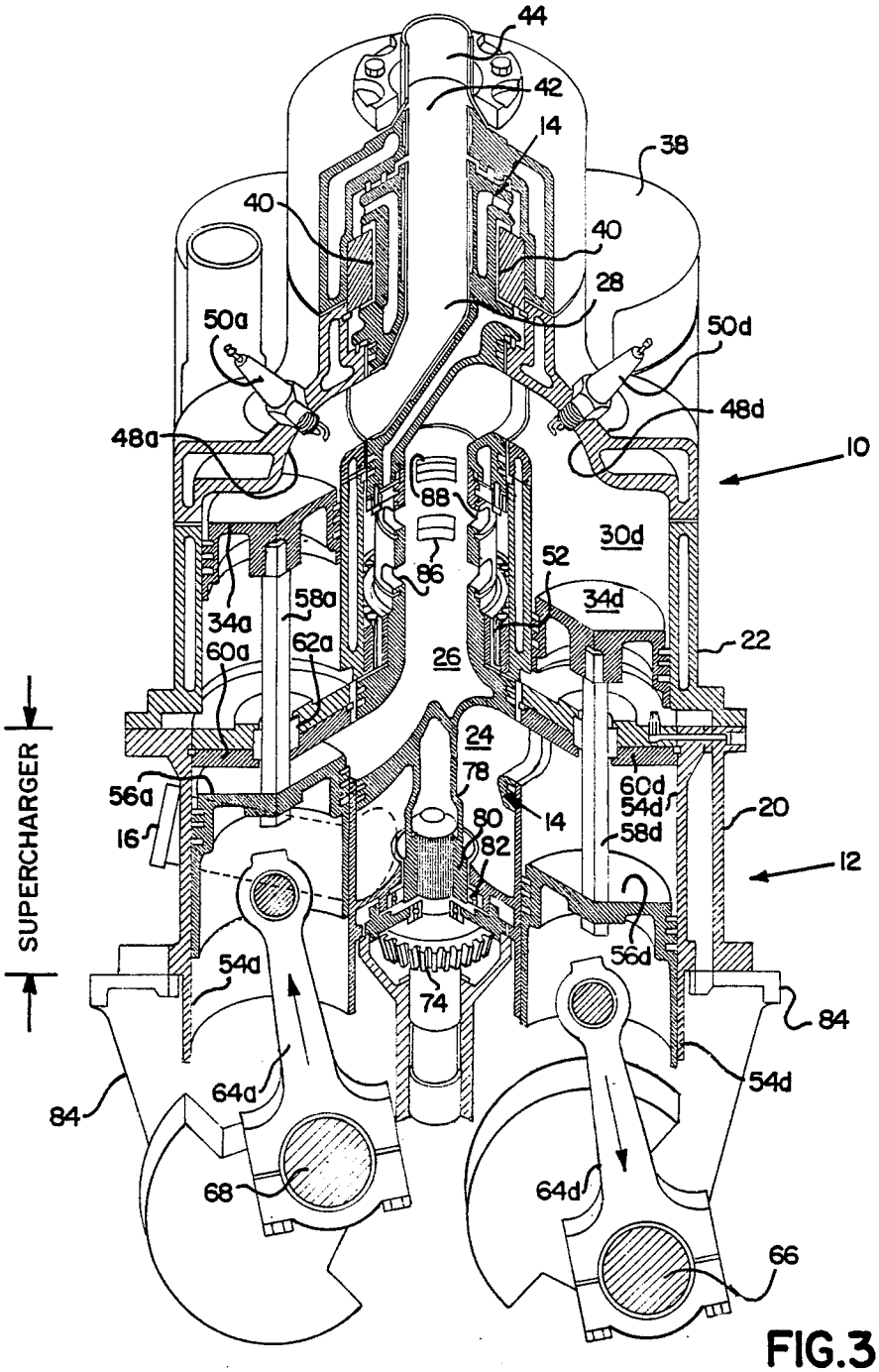
FIG. 3 is a perspective drawing of the engine with a longitudinal portion cut away essentially along the section line 3—3 of FIG. 5.
Figure 11:
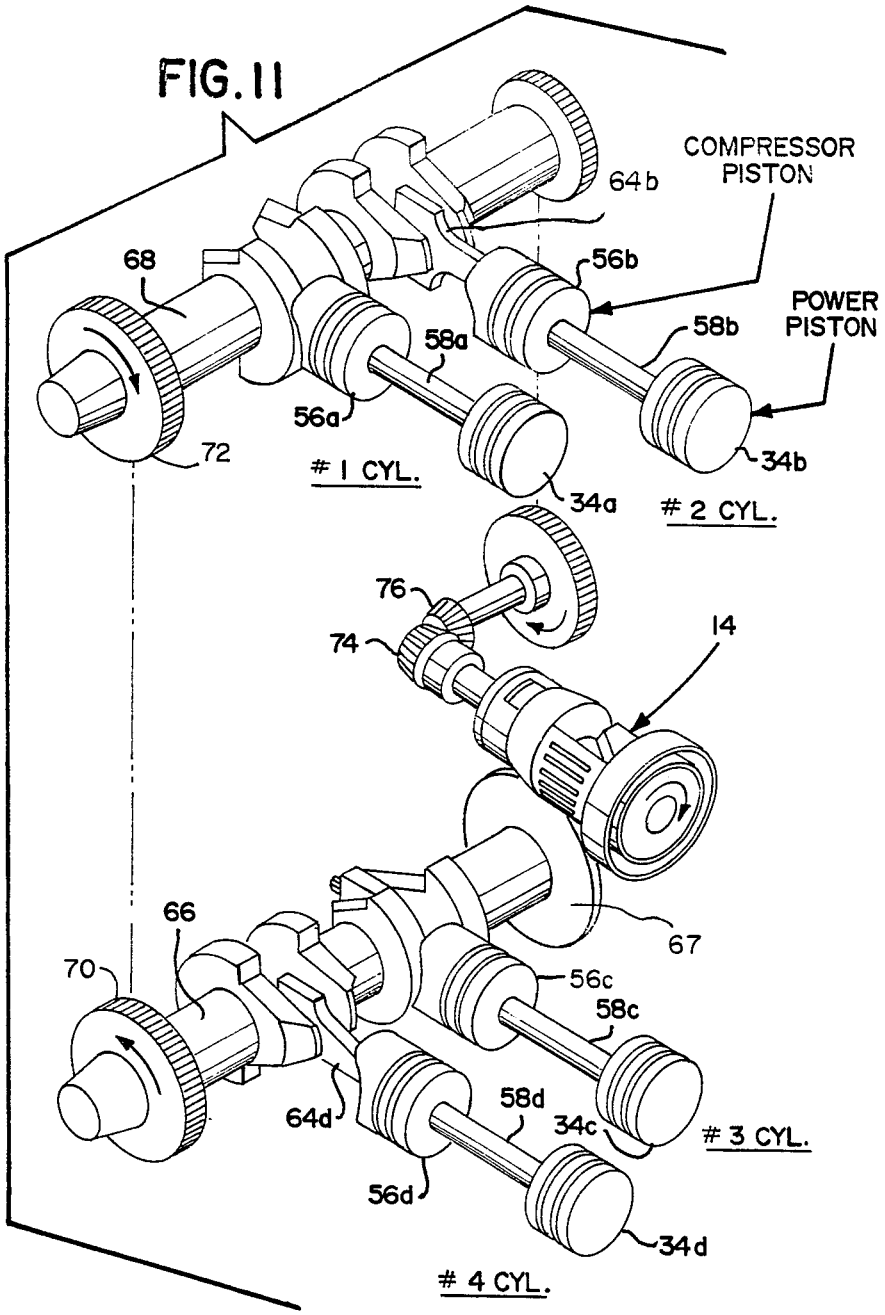
FIG. 11 is an enlarged perspective exploded view showing schematically the pistons and drive structure for the engine.

As will be seen by comparing FIGS. 1 and 3 with FIG. 11, each of the piston rods on a given crank shaft is driven 180° out of phase with the other. FIG. 11 shows graphically, for example, that the power piston 34*a* is rigidly connected to supercharger piston 56*a* by piston rod 58*a* and the two pistons are driven together by connecting rod 64*a* connected to crank shaft 68. The same thing is true of pistons 34*b* and 56*b*, except that these, are clearly seen to be 180° out of phase, so that when one set is at the top of its stroke, the other is at the bottom of its stroke. The same thing is true of the pistons 34*c* and 56*c* and 34*d* and 56*d*. The crank shafts 66 and 68 are connected to gears 70 and 72, respectively, which cause them to rotate in opposite directions. Each crank shaft is arranged such that opposite or alternate pistons are in phase and adjacent pistons are out of phase with one another and the difference in phase between the two sets of pistons is 180°.

As shown in FIG. 11, the rotary valve 14 is driven by coaxial bevel gear 74 which meshes with bevel gear 76. Suitable gear coupling in the system is provided to insure through bevel gear connections 74 and 76 that the rotary valve 14 is driven in synchronism with the crank shafts but effectively rotates at half the speed of the crank shafts. Thus, for every rotation of each of the crank shafts, the rotary valve rotates only half a revolution. In other words, the timing of the gears interconnecting the crank shaft gears is such that the crank shafts make two complete revolutions, and their associated pistons complete two full cycles, for every revolution that the rotary valve makes. Gear 74 has an axial shank which preferably is provided with splines for inter-axial engagement with splines within an axial tubular cavity 78 in the gear end of the rotary valve 14 and 80 in FIGS 9 and 10. The outer surface of the tubular cavity is also preferably supported on the block portion 20 by another set of bearings and seal 82 in FIGS 1 and 4.

It will be observed that the crank case area 84 is to be of conventional construction so that the detailed discussion of its structure and operation is unnecessary.

Figure 4:
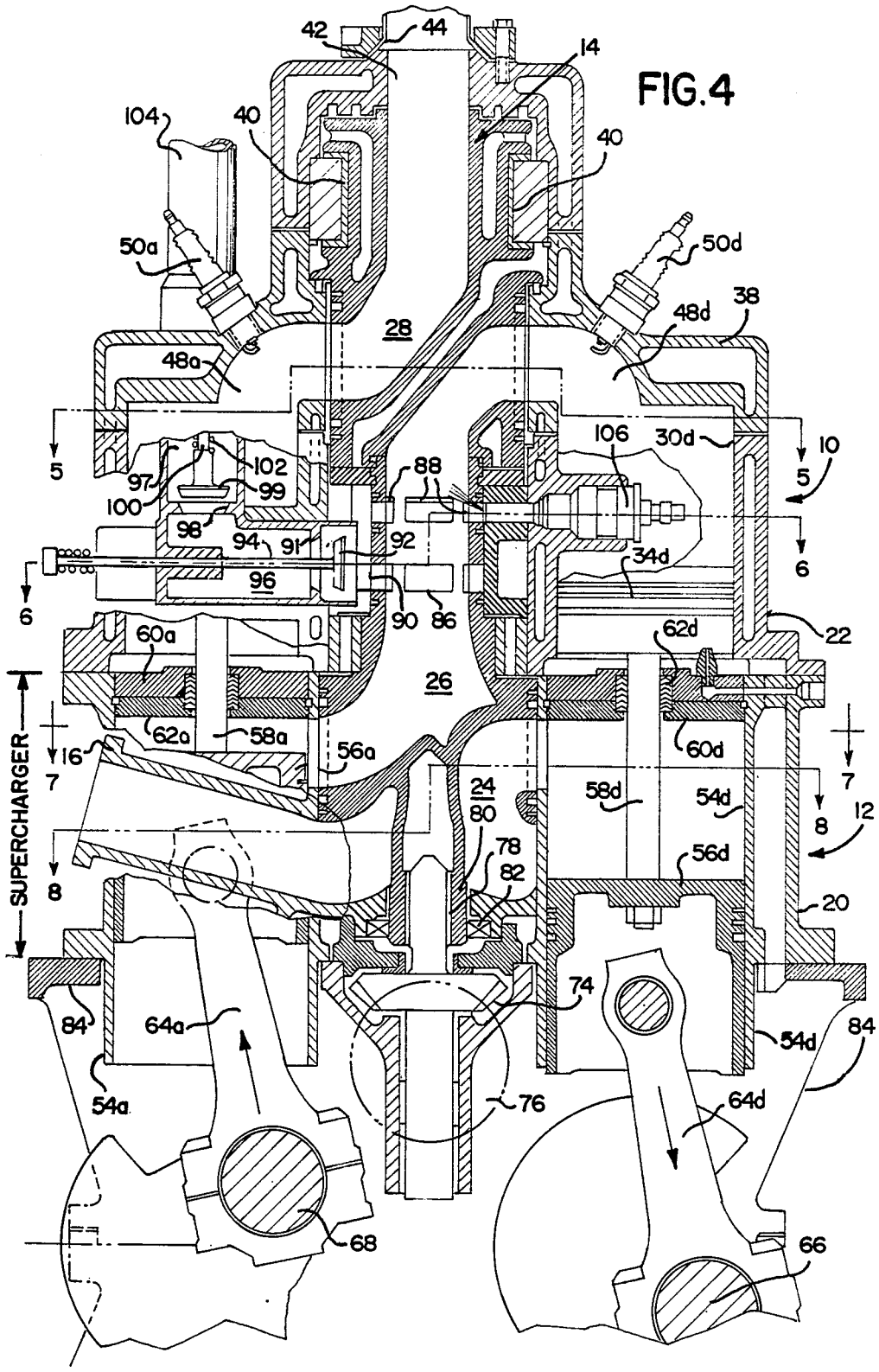
FIG. 4 is a sectional drawing of the engine taken along line 4—4 of FIG. 5.
Figure 6:
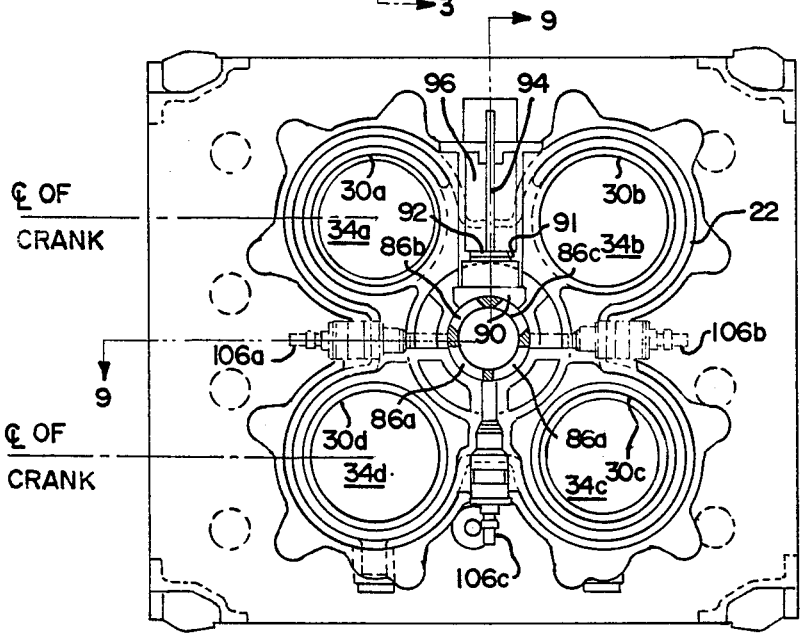
FIG. 6 is a cross-sectional view of the engine taken along line 6—6 of FIG. 4.
Figure 9:
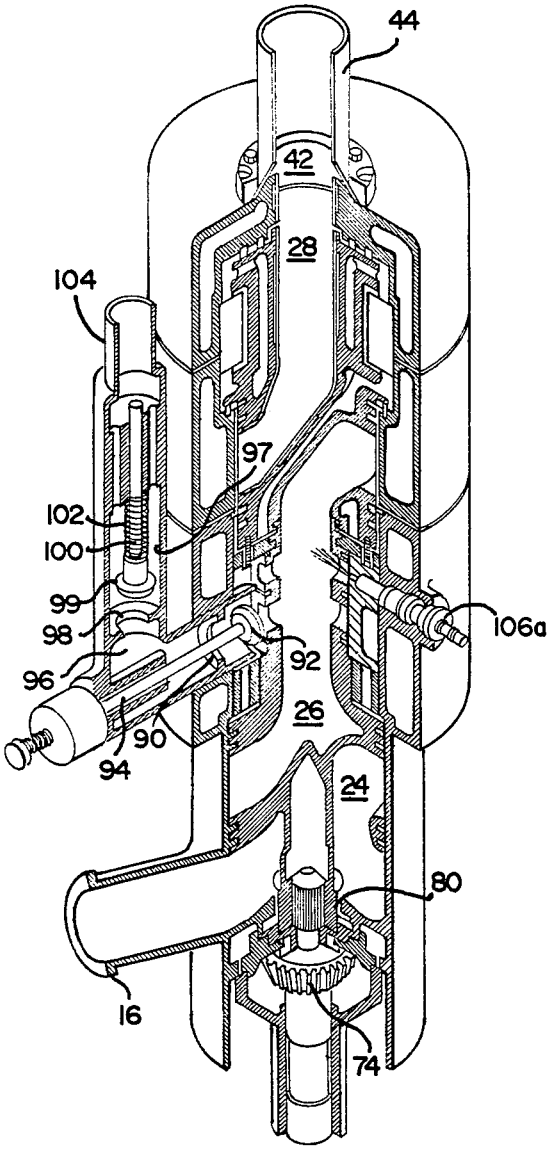
FIG. 9 is a perspective view of the rotary valve and the surrounding engine portions with a wedge-shaped section cut out as shown along line 9—9 of FIG. 6 to show in section cooperating portions of the housing and the rotary valve.
Figure 10:
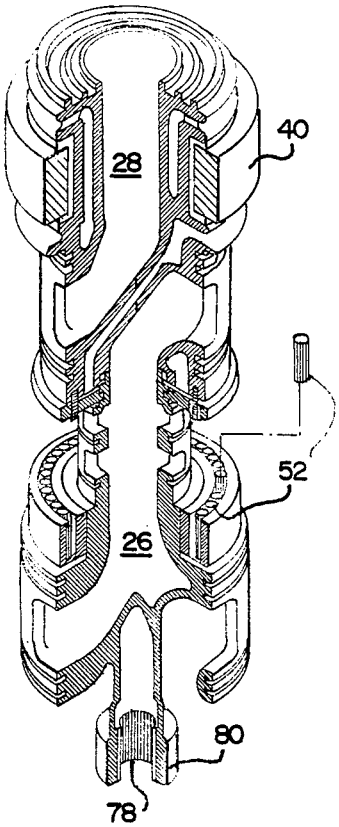
FIG. 10 is a perspective view of the rotary valve with a pie-shaped section corresponding to that of FIG. 9 cut away and showing the needle bearing support structure.

Referring now to FIGS. 9, 10 and 11, the rotary valve and the portion of the engine block structure containing it are illustrated. FIG. 9 shows the cylinder head and portions of the blocks with the actual cylinder areas ignored to better visualize the containment of the rotary valve within its aligned bores. It will be observed in FIGS. 1, 1A, 3, 4, 9 and 10 that there are at one axial level in the passageway 26, inter-connecting the supercharger with the power cylinders, a first plurality of ports through the rotary valve wall, FIG. 6, ports 86*a*, 86*b*, 86*c* and 86*d*. FIG. 4 shows a second plurality of ports 88*a*, 88*b*, 88*c* and 88*d* through the rotary valve wall lies at a second axial level after the first ports in the direction of flow. These openings allow fuel to be injected into passageway 26. The ports 86*a*, 86*b*, 86*c* and 86*d* are at the level of a cylindrical valve duct 90 arranged generally radially to the rotary valve and extending through the wall of block section 22. Duct port 96 provides a ring valve seat 91 and a movable valve 92 supported by the block 22 on stem 94. The valve is open as shown in FIG. 1 or closed as shown in FIG. 6 in accordance with adjustment through valve stem 94. Valve channel 96 opens at right angles into a valve channel 97 through valve seat 98 with which pressure sensitive valve 99 cooperates to regulate the pressure of air delivered from the supercharger. Valve 100 is tensioned by spring 102 to allow valve 99 to open upon occurrence of a predetermined pressure which overcomes spring 102 to move the valve 100 away from seat 98.

The rotary valve as seen in FIG. 10 shows the peripheral cylindrical and end surfaces provided with channels to contain suitable means to provide sealing between the various portions of the rotary valve providing different functions. Sealing material may be conventional and seals may be of the type discussed in my U.S. Pat. No. 4,444,161 of Apr. 24, 1984.

FIG. 12 shows graphically the cycles of the interconnected power and supercharger cylinders, one plot for each of the cylinders involved. Of particular interest in these diagrams is the changing position of the rotary valve relative to the engine block and the cylinder ports. Of course, the rotary valve changes position as a unit so that a particular position placing passageways opposite ports of the power cylinders requires a corresponding position placing passageways opposite ports of the supercharger cylinders, which is repeated rotation after rotation. As indicated by the arrows, the rotary valve, as seen in each section, is moving in the direction of the arrows shown in FIGS. 15 and 16. Rotation as viewed in these diagrams is always clockwise looking down onto the valve from the top. Each of FIGS. 12A, 12B, 12C and 12D show graphically how two supercharger cylinders, e.g. 54*b* and 54*d*, connect to and fill one power cylinder, e.g. cylinder 30*a*, through the rotary valve 14. FIGS. 12A, 12B, 12C and 12D together show how successive power cylinders are filled from the specific pair of superchargers as the valve rotates. One revolution (360°) of the rotary valve 14 equals two revolutions (720°) of the crank.

FIG. 13A and 15 represent the exhaust of power cylinder 30*a* through passageway 28 being completed as that of exhaust from cylinder 30*b* is begun. The rotary valve 14 is just closing the ports in supercharging cylinders 54*a* and 54*c* which have just completed compression and hence the discharge from 54*a* and 54*c* through passageway 26 into the power cylinder 30*d* has been almost completed. Power cylinder 30*d* is, therefore, about to be closed off to begin compression of the mixture as the valve 14 rotates. The power piston in cylinder 30*c* is near the top of its compression stroke. The energy supplying the force to produce compression in cylinder 30*d*, as well as power output, is the ignition of the explosive mixture in cylinder 30*c* by firing spark plug 50*c* in the duct 48*c* in FIG. 3 constituting part of the volume of cylinder 30*c* into which the mixture has been compressed and burned. Firing is selectively accomplished to provide proper timing to maximize power. The piston in cylinder 30*b* is at or near the bottom of its power stroke and as it begins to rise the combustion gases begin to flow into exhaust through passageway 28. As the rotary valve opens passage 28 further, the exhaust is permitted to exhaust out of cylinder 30*b* more and more rapidly as shown in the corresponding diagrams of FIGS. 16 and 17. Also, as the valve reaches the position of FIG. 16, the power piston in cylinder 30*a* has started down from its top position of FIG. 15 and the power piston in cylinder 30*d* has started to rise compressing the combustible air/fuel mixture. These directions of movement continue through to the position of FIG. 21 in the course of which valve 14 rotates 90°. This completes, for example, the exhaust for a Diesel or spark ignition engine of cylinder 30*b* and the compression of the explosive mixture in the cylinder 30*d* due to upward movement of their respective power pistons.

Similarly, the pistons in cylinders 30*a* and 30*c* complete their intake and power strokes, respectively. Because cylinder 30*c* is being driven down under the explosive force of the mixture in the cylinder which has been ignited, the explosive force needs to be contained or shut off by the rotary valve 14 until that full force of the driving explosion or combustion has been completed. At the same time, the cylinder 30*a*, as it moves down, draws into it from passageway 26 in the rotary valve the compressed air or air/fuel mixture which is being discharged from supercharger cylinders 54*b* and 54*d*. At the same time, cylinders 54*a* and 54*c* are drawing in air from the intake through passageway 24 as their supercharger pistons move down. The air which had been previously drawn into cylinders 54*b* and 54*d* on the previous cycle meantime is being compressed as the supercharger pistons move up in those cylinders. As the valve reaches the position of FIGS. 14B and 19, the compressed air from those supercharger cylinders begins to enter the Y-shaped distribution passageway 26. Because cylinder 30*a* at that time is fully open to passageway 26, the mixture can enter that power cylinder. Sometime, at about position of FIG. 17, one or more injectors inject fuel into the passageway 26 through the ports 88 of FIG. 4 in the rotary valve 14 whence it is carried as a mixture with compressed air into the cylinder. The ports 88 are, of course, positioned in accordance with the injection timing.

Figure 27:
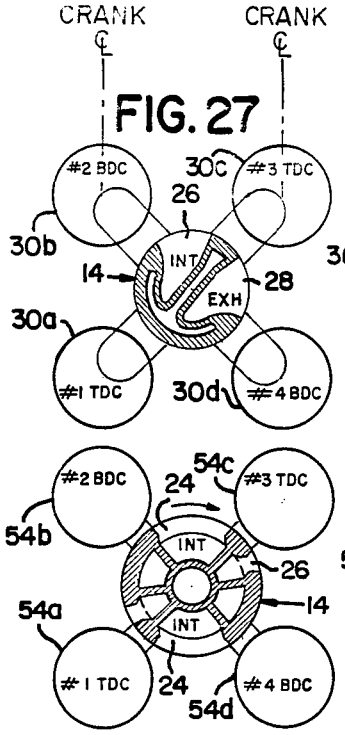

FIGS. 21 through 26 represent the opposite cycle or phase of movement of the power pistons in the cylinders. The pistons 34*b* and 34*d* having reached the top of their stroke in cylinders 30*b* and 30*d* now begin to move down while the pistons 34*a* and 34*c* in cylinders 30*a* and 30*c* move up from the bottom position of FIG. 21. Since the supercharger pistons in cylinders 54*a* and 54*c* are interconnected with the power pistons in cylinders 30*a* and 30*c* the supercharger pistons also move up and compress the air or air/fuel mixture, ultimately discharging it through passageway 26 to intake power cylinder 30*b* shown in FIGS. 22 to 27. As the supercharger pistons in cylinders 54*b* and 54*d* move in phase from the top of the cylinders in FIG. 21 downward, they draw in air into passageway 24 from the intake 16, FIGS. 1, 1A, 3 and 4, during the cycle. Ultimately, in FIG. 25, the supercharger cylinders 54*a* and 54*c* are opened by Y-shaped passage 26 to power cylinder 30*b*. Fuel is injected into the stream passing along that passage so that by FIG. 27, the passage is almost closed, and by FIG. 28 it is closed. Ignition of the mixture in cylinder 30*a* FIG. 27 drives the piston 34*a* downward. Through the same sequence, the piston 34*d* in cylinder 30*d* in which the piston is moving upward discharging exhaust to passageway 28 and 42 in rotary valve 14 out through the top of engine FIGS. 3 and 4 to the exhaust pipe 44. In FIG. 27 the supercharger pistons in cylinders 54*a* and 54*c* are at the top dead center and the supercharger pistons in cylinders 54*b* and 54*d*, at the bottom dead center of their strokes. Cylinder 30*d* which has just gone through its power stroke starts to exhaust through passageway 28 as the piston moves up through the sequence to the position of FIG. 32. At the same time the power piston moves up in cylinder 30*b*, compressing the air or air/fuel mixture in that cylinder shown in FIGS. 28 to 32. Cylinder 30*c* also has a downward moving piston so that when the movement of the rotary valve is properly positioned, as shown in FIG. 31, cylinder 30*c* draws compressed air from the supercharger cylinders 54*b* and 54*d* through passageway 26.

Figure 28:
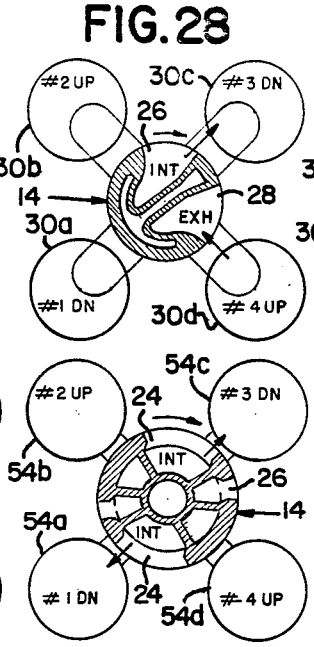
Figure 29:
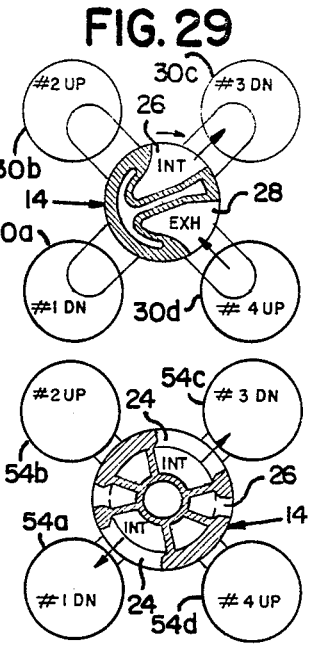
Figure 30:
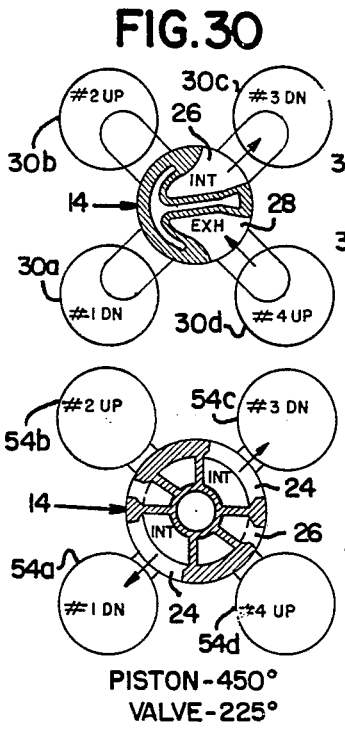
Figure 31:
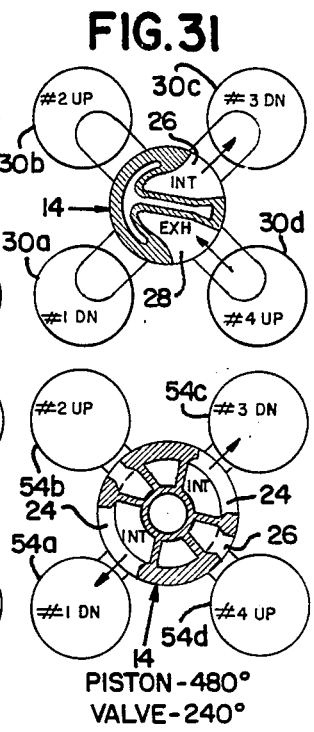
Figure 32:
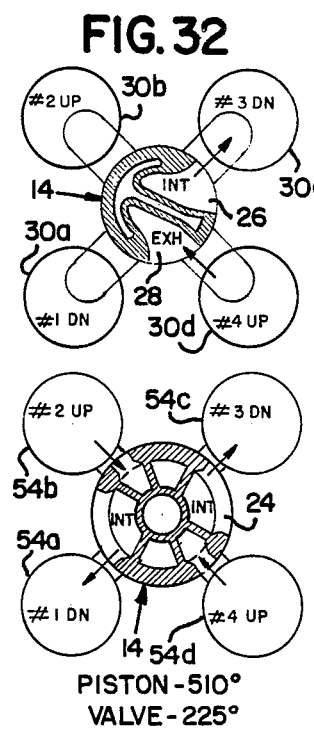
Figures 33, 34, 35, 36, 37, 38:
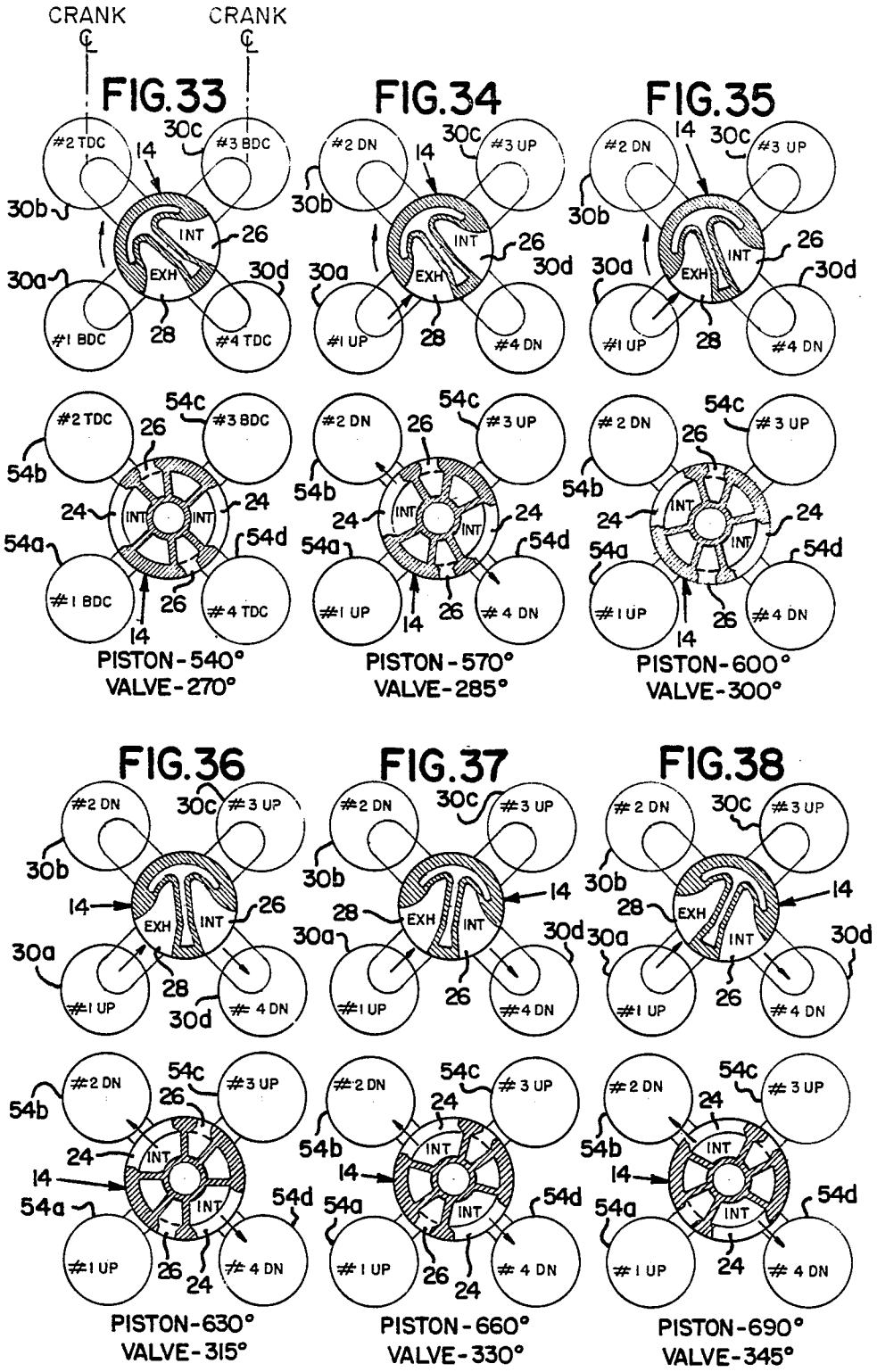

Supercharger cylinders 54*b* and 54*d*, which are compressing FIG. 28 to FIG. 30 are closed for a major part of the upward movement of the pistons and finally open between FIG. 30 and FIG. 31 so that they can together feed their compressed air into passage 26 past the fuel injection means into the power cylinder 30*c* on its intake stroke shown from FIG. 28 to FIG. 33. The other cylinders 54*a* and 54*c* which have their supercharger pistons 56*a* and 56*c* in downward motion are connected by branches of passage 24 to the intake pipe 16 and are being charged. Thus, FIGS. 27 to 32 repeat FIG. 15 to 20 for the supercharger section of the engine, and repeat its two cycle operations every two strokes of the piston. However, the power section, which has four different cycles, repeats every other crank revolution. Each power cylinder performs a different function at a different time and does not repeat that function until after four full strokes of the piston, or four cycles of the engine, or two crankshaft revolutions. Thus, in FIGS. 27 through 32, the cylinder which is firing is cylinder 30*a*. The cylinder undergoing compression on its upward stroke is cylinder 30*b*. Cylinder 30*c* is in intake phase on its downward stroke, and the cylinder 30*d* is in exhaust phase in its upward stroke.

FIGS. 33 through 38, then, show the final cycle of the four cycle power section wherein cylinder 30*b* is firing and driving the piston down. Cylinder 30*c* is undergoing compression. Cylinder 30*d* is in its intake phase fed by supercharger cylinders 54*a* and 54*c*, and cylinder 30*a* is starting its exhaust phase.

The next cycle, of course, repeats the action of FIG. 15 through 20 with cylinder 30*c* in its power, driving or combustion phase, cylinder 30*d* in its compression phase, cylinder 30*a* is starting its intake phase, and cylinder 30*b* is in its exhaust phase.

Figure 2:
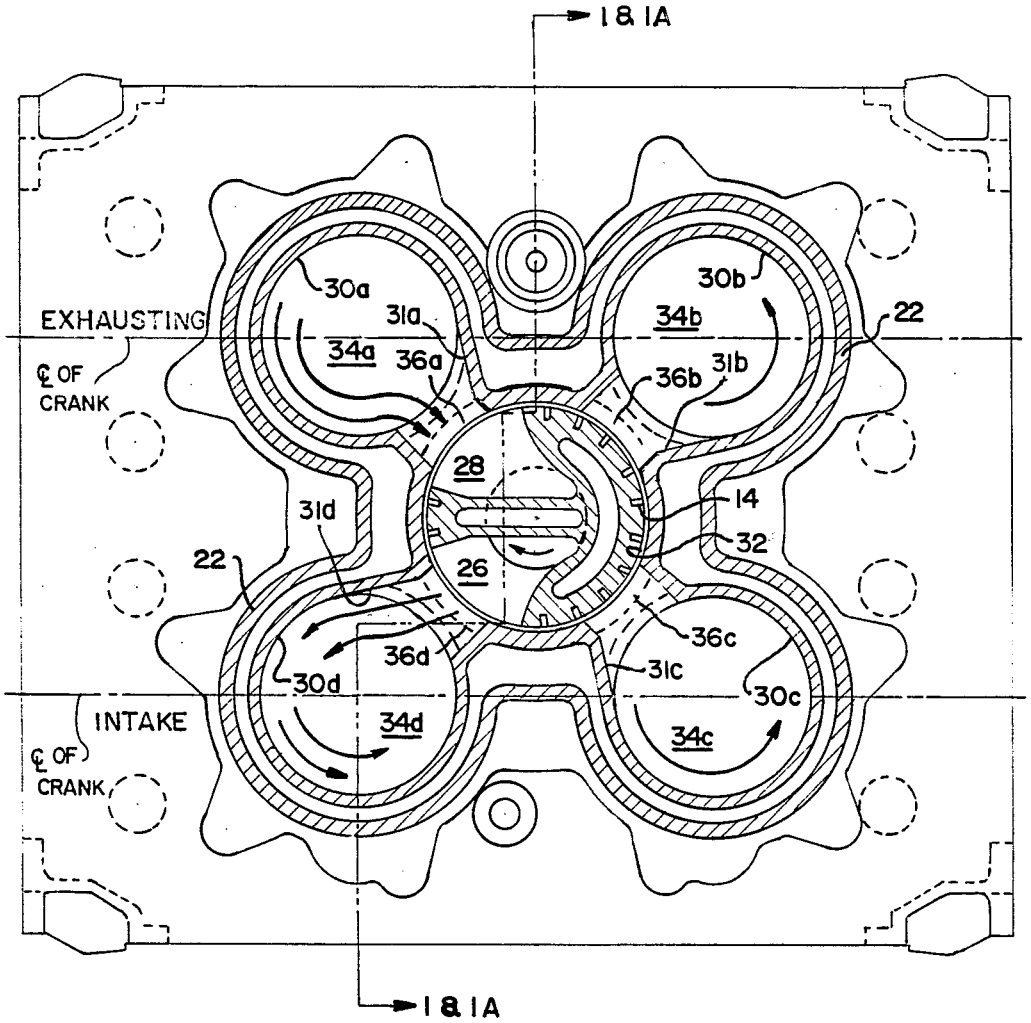
FIG. 2 is a cross-sectional view taken through the engine of FIG. 1 and FIG. 1A along line 2—2.

Referring to FIG. 2, the air or air/fuel mixture passes from passageway 26 in the rotary valve through intake port 36*d* into power cylinder 30*d* with a high speed, helical swirling motion. Designing the structure to result in a high pressure spiral swirling motion takes advantage of the resultant forces directing the air fuel mixture as it exits the passageway 26 and enters the intake ports. The resultant force is derived from a combination of centrifugal and tangential forces acting on the air or air/fuel mixture in the turbo rotary valve. The walls 31*a*, 31*b*, 31*c* and 31*d* have an angled direction of approach from passageway 26 to each power cylinder. As the pressurized air/fuel mixture passes through the port openings 36*a*, 36*b*, 36*c* and 36*d*, a tangential blending of the mixture to the cylinder wall results in allowing the pressurized gas to flow in a direction to follow the bounding walls with a high velocity as the passageway 26 passes each port. Consequently, the air or air/fuel mixture is directed to and follows the cylinder wall which causes it to turn in a helical spiraling direction (here counterclockwise) as shown by the arrows. With the geometry of the embodiment shown and described and the stated direction of rotation, the tangential port wall is provided on the right hand side facing the ports. The high speed spiral swirl causes the air and fuel to atomize into a lean homogeneous mixture which due to the effect of the piston continues a helical swirling motion down the cylinder during the full intake stroke and spiral swirling up the cylinder during the full compression stroke. A lean homogeneous mixture and the high helical swirl are necessary for efficient fast burn combustion. The continued high swirling action during ignition and the long power stroke provides an added advantage because of the counterclockwise spiral up the exhaust stroke in which the exhaust gases are centrifugally and tangentially pushed out into the rotating exhaust port causing a rapid and complete expelling of burned gases during the exhaust phase of the four stroke cycle engine.

The rotary valve is a distributor type of a turbine valve in which the air or air/fuel mixture for the intake phase is fed into the bottom and up through the center part of the valve and feeds intake air or air/fuel mixture into each of the four cylinders consecutively and sequentially as the valve turns at half the crankshaft speed past each of the four cylinder ports. The exhaust gases are expelled sequentially in succession through each of the four cylinder ports, one phase ahead of the intake phase, and out the top of the rotary valve.

FIGS. 39 through 53 show another embodiment of the present invention wherein an engine is structurally very similar to that shown in FIG. 1, FIG. 5 and FIG. 7, but one designed to be a two cycle engine instead of a four cycle engine. However, because a two cycle engine is provided, two supercharger cylinders feed two power cylinders at the same time. Therefore, the rotary valve 14' is considerably modified such that there is a single Y-shaped intake passageway 24' and a common, or "X" shaped passageway 26' connecting both of a pair of diametrically opposed superchargers to intake ports of a pair of power cylinders. Alternatively, there can be two separate passageways each connecting a single supercharger cylinder on compression cycle with a single one of the opposite two power cylinders on intake, such that two power cylinders are simultaneously being fed with air or air/fuel mixture. In either event, two power cylinders are simultaneously being fed with the compressed air of two opposed supercharger cylinders.

The sections of FIGS. 39, 40, 41, 42, 43 and 44 illustrate how the rotary valve passageway construction in the two cycle configuration cooperates with the various ports. The supercharger section requires an intake passageway 16' (FIGS. 39 and 40) which simultaneously feeds through the axial passage 24' in the crank case end of rotary valve 14' into two, opposed in phase, supercharger cylinders, such as **54*b'* and 54*d'*, as seen in FIG. 39, 40, 43 and 44. The power section preferably has an X-shaped rotary valve passageway 26' which allows discharge from two supercharger cylinders to supply compressed air or air/fuel mixture to two power cylinders. Passageway 28' also exhausts from an opposed pair of cylinders using separate exhaust ports 37*a* and 37*c* or 37*b* and 37*d* at a higher level in the power cylinders 30*a'*, 30*c'*, 30*b'* and 30*d'*, than intake ports 35*a*, 35*c*, 35*b* or 35*d*. At the same time that power cylinders 30*a'*, 30*c'*, 30*b'* and 30*d'* are in their initial exhaust cycle stroke, the intake ports 35*a*, 35*c*, 35*b* or 35*d* are open and supplying air or air/fuel mixture to the power cylinders. Otherwise, it will be observed that the parts are so similar in the two embodiments that the same number designators have been applied to corresponding parts, but with the addition of primes to those of FIGS. 39 through 53**.

The supercharger cylinders **54*a'*, 54*b'*, 54*c'* and 54*d'*, instead of being the same size, are preferably larger in diameter than power cylinders 30*a'*, 30*b'*, 30*c'* and 30*d'*. For example, a supercharger cylinder whose area is twice the area of the power cylinder, will provide approximately twice the volume of compressed air or air/fuel mixture which is the equivalent of the volume of two cylinders in the FIG. 1** arrangement. Since the stroke of the interconnected pistons necessarily remains the same, any change in cylinder volume, to whatever degree designed for a particular system, has to be accomplished by the enlargement of the area of the pistons and or the cross-sectional area of the supercharger cylinder in a situation where effectively two supercharger cylinders feed two power cylinders which are 180° out of phase. However, some increase in volume in some designs is needed in two cycle operations to achieve improved cylinder scavenging and operation by use of a supercharger. The power cylinder represents a uniflow cycle where the intake air or air/fuel mixture enters the cylinder at the bottom and the exhaust gases exit at the top of the cylinder.

In preferred embodiments for simplicity of design, the rotary valve 14' is made symmetrical and the adjacent ends of the "Y-shaped" passageway 24' and "X-shaped" passageway 26' are interspersed. "Y-shaped" is used in the functional sense of being double branched, and in some cases such a passage might be "T-shaped". Similarly, an "H-shaped" instead of "X-shaped" passage could be used within the scope of the term. It will, however, be understood that "Y-shaped" means a passageway configuration wherein two ports at the same axial level are fed by branches of the passageway. In all designs, passageways are designed to cause a helical flow to swirl around the cylinder as it enters the intake ports.

Structurally the biggest change is in port construction. In FIGS. 39, 40, 43 and 44, the supercharger cylinders **54*a'*, 54*b'*, 54*c'* and 54*d'* have ports 33*a*, 33*b*, 33*c* and 33*d*, respectively. Each of these ports receives input of air from the engine air intake 16' through the passage 24'. Compressed air is discharged, in turn, from each of these ports into passage 26'. At least during part of each quarter rotation of the valve, compressed air is discharged from a pair of opposed cylinders while intake occurs into a pair of opposed cylinders which are 180° out of phase with the first pair. Passage 26' is preferably X-shaped or H-shaped: that is, it has not only two input branches from the cylinders 54*a'* and 54*c'* or 54*b'* and 54*d'* but two output branches to opposed power cylinders 30*b'* and 30*d'* or 30*a'* and 30*c'* through input ports 35*b* and 35*d* or 35*a* and 35*c*. These input ports are just above the lowermost position of the power piston, as illustrated in FIG. 40, in the positions of pistons 34*b'* and 34*d'*. These input ports 35*a*, 35*b*, 35*c*, 35*d* are quickly cut off as the pistons move upwardly in a two cycle engine. Exhaust is accomplished through ports 37*a*, 37*c*, 37*b* and 37*d*, through a branched Y-shaped passage 28' which lead to exhaust 44'**.

As in the four cycle embodiment, fuel is introduced into passage 26' through port 88' by fuel injector 106' as shown in FIG. 39. Injection is timed so that fuel enters passage 26' through lateral ports 88'.

In the two cycle engine design the rotary valve turns at ½ engine speed, the same as for the four cycle engine. However, the rotary valve could be designed to turn at engine speed.

Cylinders are also provided with liners **39*a*, 39*b*, 39*c* and 39*d*. The liners are perforated at the input ports 35*a*, 35*b*, 35*c* and 35*d* to provide a grid 41*a*, 41*b*, 41*c* and 41*d*, the bars of which are cut at an angle off radial generally parallel to the average direction of the resultant flow of the air fuel input flow so as to provide fluid directing slots. The input port wall toward which flow would be directed is also generally parallel to the average flow direction and arranged tangential to the cylinder wall. The curved cylinder wall receives the flow with a minimum of disturbance to generate the high helical swirling motion within the cylinders of air or air/fuel mixture. In the embodiment illustrated with the rotational direction indicated, the spiral swirling is in a counterclockwise direction as it flows around the inside of the cylinder (as suggested by the arrows in cylinders 30*a'* and 30*c'* in FIGS. 42 and 45). The swirl continues in the cylinders even during compression which causes efficient lean mix, fast burn combustion. After firing near the top of the stroke, the piston is driven downwardly. At the appropriate time in the downward movement of the piston during the two cycle period, the passage 28' is brought into register with the exhaust passages 37***a* and 37*c*, as seen in FIG. 41, or with exhaust passages 37*b* and 37*d* a quarter of a rotation later.

The continuing helical swirling motion in the two cycle engine is very similar to the four cycle engine except the intake air is fed into the bottom of two cylinders and flows through vertical guides in a spiral swirling counterclockwise direction. This counterclockwise rotating air helps to force the products of combustion through the exhaust ports at the top of the two cylinders where they meet in the exhaust passageway in the rotary valve and out through the exhaust port on the top of the engine. It is most advantageous during the two cylinder intake and the two cylinder exhaust phases of the two cycle engine in rapidly and completely expelling burned gases through the exhaust ports at the top of the cylinders before the air/fuel mixture is introduced into the cylinder near the bottom of the stroke so that no fuel mixes with the hot exhaust gases before the exhaust port closes.

FIG. 45 diagrams and FIGS. 42 and 43 show representative tandem power and supercharger cylinders. Output from compressor 54*b'* and 54*d'* in FIG. 43 feeds power cylinders 30*a'* and 30*c'* in FIG. 42 through passageway 26' at this particular point in the cycle.

FIGS. 45-1, 45-2 and 45-3 show the relative timing in number of degrees of the intake and exhaust ports rotary valve openings and closings at the power cylinder intake and exhaust port positions as represented by crank angle position in degrees of the opposed cylinders in one rotation of the crank shaft. Only three examples are shown illustrating valve timing variations possible in the valve design, and it will be understood other variations are possible.

FIGS. 46-1, 46-2 and 46-3 correspond to FIGS. 45-1, 45-2 and 45-3, respectively, showing variations possible in the design and phasing of the number of degrees of the supercharger valve timing of the intake and exhaust port rotary valve openings and closings in conjunction with changes in the three examples of cylinder port openings. FIGS. 46-1, 46-2 and 46-3 are views taken at the level of the supercharger ports illustrating valve structure angles and relate to the phasing of the supercharger compressor at discharge relative to the power cylinders to which they are connected at intake. The angles shown give a quantitative idea of the way in which the passages in the valve are timed relative to the ports 33*a*, 33*b*, 33*c* and 33*d* to regulate phase opening and closing.

FIGS. 47A, 47B, and 47C show, respectively, schematic diagrams representing the three levels of the ports in a two cycle engine rotary valve. FIG. 47A is a cross-section taken through power cylinders 30*a'*, 30*b'*, 30*c'* and 30*d'* at the level of exhaust port 37*a*, 37*b*, 37*c* and 37*d*. FIG. 47B is a cross-section also through the power cylinders at the level of intake ports 35*a*, 35*b*, 35*c* and 35*d* just above the bottom of the piston stroke. FIG. 47C is a cross-section taken through the supercharger or compressor cylinders 54*a'*, 54*b'*, 54*c'* and 54*d'* at the level of the common ports providing both for intake and discharge. FIGS. 47A, 47B and 47C are related to the same position of rotary valve 14'. FIGS. 48A, 48B and 48C through 54A, 54B and 54C are all related in the same way as FIGS. 47A, 47B and 47C in that figures with common numbers represent the same rotary valve position which is defined by relative piston and valve position angles shown beneath the final figure in each sequence of figures. The sequence of three related figures is intended to illustrate consecutive valve positions through the major valve and port cooperation sequences in a cycle. FIG. 47A, 47B and 47C show the valve and pistons in an arbitrary position where the piston is in its 160° position (its crank pin position) and the valve is in an 80° position. Again, it will be understood that the crank (and pistons) move at twice the rotational speed of the rotary valve. FIGS. 48 through 53 show the rotary valve 14' in a sequence representing a half rotation taken in 22½° steps, or 45° steps for the crank shaft. It will be understood that the other half rotation is functionally a mirror image of the half shown and the second cycle is repetitious of the first. The two, like the four, cycle system is symmetrical with pistons in opposed cylinders being in phase and those of intermediate cylinders being 180° out of phase. The supercharger and the power cylinders in axial alignment are coupled mechanically and maintain the same phase.

The present invention also has the advantageous feature of being modular in its construction. FIGS. 56A, 56B, 56C and 57 illustrate how engine components are assembled into a standard non-supercharged module consisting of the engine block section 10 extending into the crankcase, the cylinder head section 110 and the rotary valve top bearing support section 112.

The module will be assembled complete with suitable sealing gaskets and all internal components including bearings, seals and rotary valve complete with bevel drive gear. The module is intended to be a replacement unit which can quickly be installed in place of a damaged or malfunctioning module with a minimum of time and effort. Cranks, connecting rods and pistons are not included in the replacement module. These parts are assembled to the crankshafts in the crankcase and remain part of the crankcase and the crankshaft section. FIGS. 54 and 55 illustrate how engine components are assembled into an engine with a supercharger in accordance with the present invention.

FIGS. 54 and 55 of course, require the tandem pistons internally to complete a supercharged engine. The supercharged module consists of the supercharger section 12 extending into the crankcase, the power cylinder block section 10, the cylinder head section 110 and the top bearing support section 112. The module will be assembled complete with suitable sealing gaskets and all internal components including bearings, seals, and rotary valve complete with bevel drive gear.

The supercharged module (like the standard non-supercharged module) is also intended to be a replacement unit which can quickly be installed when necessary. Cranks, connecting rods and tandem pistons are not included in the replacement module. These original parts would be reassembled in the crankcase of the rebuilt engine.

It should be noted that the various sections of the module are bolted together and are easily separable from each other for easy access to internal structure for repair and maintenance. This means also that conversion from a standard engine as shown in FIGS. 56B and 56C to a supercharged engine as shown in FIGS. 54 and 55, is possible with the addition of a supercharger section. Removal of the supercharger section from a supercharged engine to convert a supercharged engine to a standard engine is also possible. Of course tandem pistons, a supercharged type rotary valve and associated components are needed for the conversion; however, these along with single pistons, rods, seals, etc. can be stocked for ready conversion.

The various sections as a practical matter can be stockpiled for use in various combinations of engines. The modular construction also allows for replacement of individual sections instead of the whole engine and allows for the stocking of fewer parts to be assembled into engines of different kinds depending upon a particular customer's order.

FIG. 57 shows the modular engine of FIGS. 56A, 56B and 56C in perspective and shows how the cylinder walls 54 or 54*a*, 54*b*, 54*c*, and 54*d* fit down in the crankcase 84 shown in FIGS. 1, 1A, 3 and 4. It will, of course, be clear that when the four cycle engine is assembled a modified rotary valve is required for a non-supercharged, as opposed to supercharged, engine omitting the passages interconnecting the supercharger cylinders with the power cylinders. The cylinders 54 in all cases extend below the lowermost section. It will be observed in FIG. 56 that in four cycle engines, where a three section engine is employed, the power cylinder block section 10 is the block above section 12 used for the supercharger in the structure of FIG. 54. It will be observed in FIG. 54 that the bosses 116′ similar to bosses 116 provided on block 10 are in position to receive bolts from the cylinder head 110 in the configuration of FIG. 56 and additionally the structure of block 12 is provided with flanges 118 which are needed to cooperate with flanges 120 on block 10 but are unused in the configuration of FIG. 56.

It will be appreciated that the structures shown in FIGS. 54 through 57 are used in connection with a crankcase 84 of the type illustrated in FIGS. 1, 1A, 3 and 4 and the system is further modular in the sense that multiple engine modules can be used with a given crankcase. The crankcase shown in FIG. 1, for example, has a removable pin which allows connection of connecting rods and pistons in each of the engine modules on the opposite sides of each of the double crankshaft crankcase sections. Thus, in FIG. 58, a composite engine without a supercharger is illustrated. Although only one crankshaft of the two is shown, it will be understood that in every case two crankshafts must be used. FIG. 1, for example, shows that, where there are four cylinders, two crankshafts 66 and 68 are used. Only two of the four pistons are schematically shown in FIGS. 58 through 73 attached to one crank shaft. It will be understood that the other two pistons must be attached to another crank shaft in a balanced fashion.

FIG. 58 illustrates the simplest configuration of a single module engine 150. This one module engine has four cylinders having only power cylinders and four pistons 156*a*, 156*b* being shown and pistions 156*c* and 156*d* attached to another crank shaft being not shown. Pistons 156*a* and 156*b* are connected by connecting rods 154*a* and 154*b* to crank shaft 152, and the other pistons have a similar configuration.

In FIG. 59, a module 151 employing a supercharger is shown. The housing is accordingly modified to include a supercharger section in this supercharged engine. The piston structure is modified to provide tandem pistons. The lower pistons 156*a* and 156*b* are supercharger pistons and are connected by piston rods 158*a* and 158*b* to power pistons 160*a* and 160*b*.

FIG. 60 shows a composite two module engine structure in which an identical second module 150′ is attached to the crank case in mirror image position and its pistons are connected to same crank shafts from the opposite side of the crank case. Pistons 156*e* and 156*f* are connected by connecting rods 154*e* and 154*f* to common crank pin bearing locations on crank shaft 152 with connecting rods 154*a* and 154*b* of pistons 156*a* and 156*b*. Pistons 156*g* and 156*h* and their separate crank shaft are not shown.

FIG. 61 shows a two module composite supercharged engine situation in which supercharged engine module, 151 is opposed by supercharged engine module 151′ connected to the same crank shaft as module 151 on the opposite side of the crank case. Here again, connecting rods 154*e* and 154*a* share a common crank pin and as do connecting rods 154*f* and 154*b*.

Without enumerating the detail of the individual structures, FIG. 62 shows three engine modules assembled similar to those of FIGS. 58 and 60. Couplings are provided between both crank shafts in each of the two crank cases, as illustrated by the coupling 162 between crank shaft 152 and crank shaft 164. Coupling 162 and the other coupling of the engine are external of the crank cases in FIGS. 62. Instead of providing a coupling, a common crank shaft may be employed as is shown in the three module supercharged structure of FIG. 63 which effectively combines the subcombinations of FIGS. 59 and 61. In FIG. 62, the opposed engine units are designated 150A and 150A′ and the single unopposed engine unit is designated 150B. In FIG. 63, the opposed engine modules are 151A and 151A′ and the unopposed engine module is 151B.

FIG. 64, a four module composite engine combines two engines like that of FIG. 60 using external couplings of their crank shafts, such as coupling 162 between shafts 152 and 164. The composite module is similar to FIG. 62 except that engine 150B is opposed by a similar module 150B′ in which the connecting rods are connected to the crank shaft 164 at the same crank pin centers. FIG. 65 is a similar engine configuration to that of FIG. 64 with a common shaft instead of a coupling 162 between two shafts and with four supercharged modules making up the composite engine.

FIGS. 66 and 67 show the five modules non-supercharged composite engine and the five module supercharged engine configurations, respectively. In FIG. 66 crank shaft 166 is coupled by external coupling 162 to crank shaft 164. Continuous crank shafts are used in the composite engine of FIG. 67.

Figure 68:
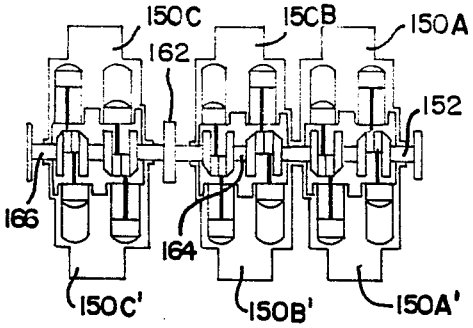
Figure 69:
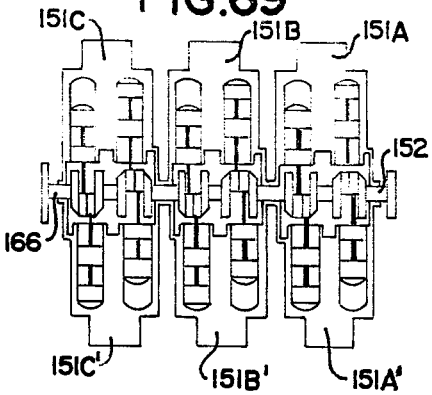

The shaft sections may employ a coupling 162 between shafts 164 and 166 as in FIG. 68, a six module non-supercharged composite engine. Alternatively, continuous shafts 152 are used in FIG. 69, a six module supercharged composite engine. It will be understood the crank cases themselves containing the crank shafts and other drive equipment could be consolidated, but part of the advantage is to provide modular construction with some sort of suitable means of coupling the shafts together. In composite engine combinations such as those using separate crank cases, means of locking the modules and separate crank cases in position relative to one another are necessary and may, for example, be a common mounting frame or chasis. The crank cases themselves represent a unifying frame to which engine modules are connected.

Figure 70:
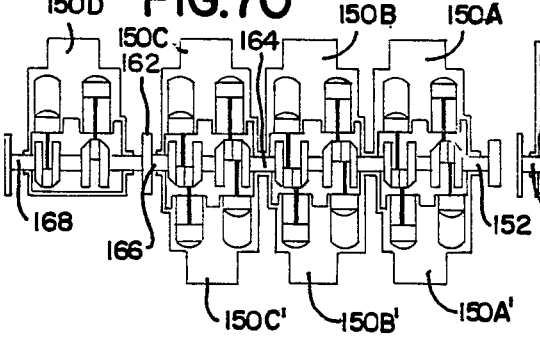
Figure 71:
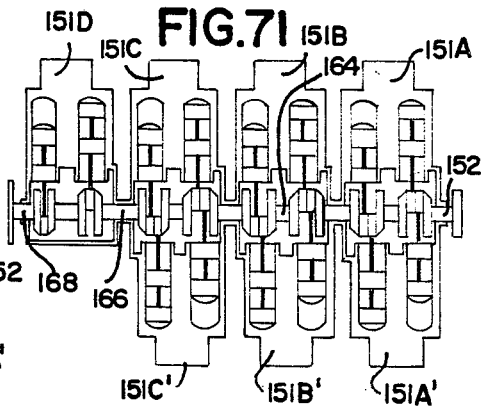

FIGS. 70 and 71 show, respectively, seven module non-supercharged and supercharged composite engines.

In FIG. 70 again an additional crank shaft section 168 is externally coupled by coupling 162 to shaft 166 in a non-supercharged engine. The composite supercharged engine of FIG. 71 employs continuous crank shafts.

Figure 72:
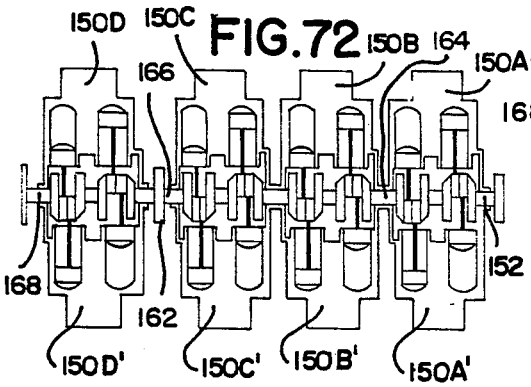
Figure 73:
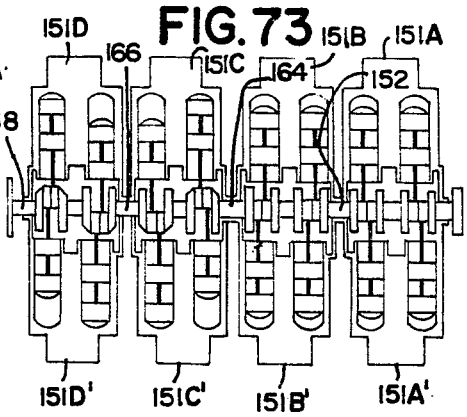

FIGS. 72 and 73 show, respectively, eight module non-supercharged and supercharged composite engines. Again, the composite engine of FIG. 72 uses an external coupling to connect separate shafts, whereas, the shafts of FIG. 73 are continuous.

The multi-module engines will be very smooth running since the crank cases can be designed to balance out the second harmonic unbalance and in some cases balance out the couples.

A two stroke cycle and four stroke cycle embodiment of the present invention have been illustrated. It will be clear to those skilled in the art that other embodiments of the invention can readily be made. Variations may take many forms and include such things as cylinders having separate input and output ports, either at the same axial level or a different axial level, or the ports may be located at the top of the cylinders with suitable modification of the rotary valve. Fuel injection means or other fuel introduction means may alternatively be included in each of the cylinders.

More than four cylinders may be arranged around the rotary valve. Where more power is desired, instead of adding to the number of cylinders around the valve, however, it may be desirable to employ pairs of opposed engines and various composite combinations suggested by those illustrated. Still other modifications include an inverted form of the engine where the power section is placed closer to the crankcase than the supercharger section. Modified rotatable drives may be employed with the rotary valve, some of which might permit axial intake as well as axial exhaust. Alternatively, the exhaust might be led through the engine block like the intake, although the form shown is preferred.

The timing of the rotary valve may be adjusted by mounting the valve within a sleeve which is adjustable axially and/or circumferentially to optimize the rotary valve port timing for the specific engine operation.

Innumerable variations on the types of seal and the different sealing functions required with the rotary valve are possible. While not particularly emphasized herein, the seals are particularly important to preserve the integrity of the various flows within the engine and to prevent interchange of those flows.

Pressure regulation may also take many forms, some very much more complex than the ones shown by way of illustration. Also, an additional section of superchargers on another axial level could be employed or even a highly efficient turbocharger for greater power boost. In fact, a whole extended engine having multiple power sections and multiple supercharger sections all with their axially aligned pistons connected together by connecting rods so that pistons in aligned cylinders move in synchronism is also conceivable as a logical extension of the present invention.

Other modifications to the present invention will also occur to those skilled in the art. All such modifications within the scope of the claims are intended to be within the scop and spirit of the present invention.

I claim:

1. An engine comprising engine block means providing:

a plurality of power cylinders having parallel axes;

an equal number of supercharger cylinders each axially aligned with a power cylinder;

a central bore having an axis parallel to the cylinder axes and having ports into each power cylinder at a common axial level at the end of the power cylinders remote from the supercharger cylinders and ports into each supercharger cylinder at another common axial level, respectively, at the end of the cylinders adjacent the power cylinders;

a reciprocating piston in each of the cylinders and an interconnecting rod between the power cylinder piston and the piston in its axially aligned supercharger cylinder;

ignition means supported on the engine block means associated with each of the power cylinders;

a rotary valve rotatably supported by the engine block means in the central bore providing at least one passageway successively connecting ports of the supercharger cylinders to a source of air, at least one passageway successively connecting ports of the power cylinders with ports of the supercharger cylinders, at least one supercharger port at a time, and at least one passageway successively connecting ports of the power cylinders to exhaust, and means providing a closure means for the inlet and outlet ports at other times;

drive means connected to the pistons and the rotary valve producing reciprocation of the pistons in predetermined phased sequence, with at least a first pair of said power pistons in phase and a second pair 180° out of phase with said first pair, and producing rotation of the rotary valve phased so that air flows through at least one passageway to the supercharger cylinders in time to be drawn in, in the cylinder intake phase, so that air compressed in the supercharger cylinders is allowed to pass through at least one passageway into the power cylinder during intake phase, and so that the spent fuel is exhausted from power cylinder ports during the exhaust phase.

2. The engine of claim 1 in which fuel injector means are provided through the engine cylinder block to inject the fuel through ports in the rotary valve to at least one passageway connecting supercharger ports to the successive intake ports of the power cylinders.

3. The engine of claim 1 in which the drive means provides that the rotary valve rotates only once for every two full revolutions of the crank shaft or four strokes of the pistons.

4. The engine of claim 3 in which there are at least four power and four supercharger cylinders, two of which supercharger cylinders are connected to intake air at a time.

5. The engine of claim 4 in which an air intake passageway through the rotary valve is provided with two branches, one for each of two supercharger cylinder ports.

6. The engine of claim 1 in which the power portion acts as a four cycle engine having conventional intake, compression, power and exhaust strokes as the pistons make two full reciprocations or four strokes in the power cylinders and the supercharger cylinders have a two stroke cycle function repeating every full reciprocation of the supercharger piston and wherein a passageway through the rotary valve connects the ports of two supercharger cylinders on their compression and discharged part of the cycle to the port of one power cylinder on its intake cycle.

7. The engine of claim 6 which consists of four power cylinders surrounding the rotary valve at one axial level and four supercharger cylinders at another, wherein the passage connecting the power and supercharger cylinders is a branched passage with the two branches connecting to the supercharger cylinder ports and one connecting to a power cylinder port.

8. The engine of claim 7 in which at least one fuel injector feed is provided through the wall of the engine cylinder block through ports through the rotary valve into the branched passageway connecting the two supercharger cylinders to the single power cylinder at an intermediate axial level.

9. The engine of claim 8 in which multiple fuel nozzles are supplied at essentially the same axial level around the block and multiple ports into the branched passageways through the rotary valve are supplied.

10. The engine of claim 7 in which separate fuel nozzles are provided in each cylinder as the ignition means permitting operation as a compression ignition or diesel engine.

11. The engine of claim 8 in which the rotary valve also provides a branched intake passageway to feed two ports at the same axial level as the two ports connected by the branched passageway to the power cylinder, such that the ports of the supercharger cylinders on the intake cycle, lying intermediate to those of the supercharger cylinders on the compression cycle, are connected to the intake passageway.

12. The engine of claim 1 in which at least in the power cylinders, the cooperating passage of the rotary valve and the cylinder port openings are so arranged that they follow the resultant path of flow of gas resulting from centrifugal and tangential forces imparted by the rotary valve and direct flow tangentially into the cylinder walls to impart a continuing helical swirling motion to the gaseous flow into the cylinder.

13. The engine of claim 10 in which each cooperating port has a wall arranged generally tangentially to the cylinder wall so as to direct the input tangentially into the curved cylinder wall to induce the spiral swirling of the gaseous flow.

14. The engine of claim 12 in which the input ports to each power cylinder are arranged so as to produce a continuous helical swirling motion to the gaseous flow in each cylinder.

15. The engine of claim 14 in which each cooperating port has a wall arranged generally tangentially to the cylinder wall so as to direct the input tangentially into the curved cylinder wall to induce the swirling of the gaseous flow.

16. The engine of claim 1 in which the power section provides a two stroke cycle engine wherein two of the power cylinders in the intake phase are simultaneously connected to two of the supercharger cylinders in the compression phase.

17. The engine of claim 16 in which the supercharger cylinders provide air precompression by providing a larger supercharger cylinder volume using a larger cylinder with a larger diameter piston.

18. The engine of claim 17 in which four power cylinders and four axially aligned supercharger cylinders are positioned around a rotary valve wherein the two power cylinders during intake are fed by two supercharger cylinders during compression.

19. The engine of claim 18 in which a passageway connects each of the cylinders in the supercharger in compression with one of the cylinders on intake in the power section which is 180 degrees out of phase.

20. The engine of claim 19 in which fuel is injected in each of the separate passageways between the supercharger cylinders and the power cylinders.

21. The engine of claim 18 in which a common passageway connects two supercharger cylinders in compression with two power cylinders during intake for a two stroke cycle power section.

22. The engine of claim 16 in which the power cylinders have separate intake and separate exhaust ports, the intake ports being located just above the lowermost position of the piston in the cylinder and the exhaust ports being located at the top of the cylinder above the uppermost position of the pistons for a two stroke cycle power section.

23. The engine of claim 22 in which at least one fuel injector is supported on the block at a selected axial level and the rotary valve is ported into the common passageway so that fuel may be injected in a common passageway between the supercharger cylinders and the power cylinders.

24. The engine of claim 17 in which the cooperating passages of the rotary valve and the cylinder port openings are so arranged that they follow the resultant path of flow of gas resulting from centrifugal and tangential forces imparted by the rotary valve and direct flow tangentially into the cylinder walls to impart a continuous helical swirling motion to the gaseous flow into each cylinder.

25. The engine of claim 24 in which each cooperating input port has a wall arranged generally tangentially to the cylinder wall so as to direct the input tangentially into the curved cylinder wall to induce the spiral swirling of the gaseous flow.

26. The engine of claim 16 in which the power cylinders are provided with liners which are perforated at the power cylinder input ports to provide a grid, the bars of which are cut at an angle to radial and generally parallel to the generally tangential port wall in order to aid in directing the fluid flow into the helical swirling mode.

27. The engine of claim 1 in which pressure regulating means pressure coupled with the supercharger cylinders and the rotary valve passage from the supercharger controls the amount of supercharge to the power cylinders.

28. The engine of claim 27 in which the pressure regulating means is controlled and adjusted by the power demand of the engine.

29. The engine of claim 27 in which pressure regulating means is adjusted to unload the superchargers for very light load operation.

30. An engine of claim 1 in which pressure regulating means in communication with the central bore is supported by the block means at an axial level permitting communication through port means in the rotary valve into at least one passageway connecting ports of the supercharger section to ports of the power section.

31. The engine of claim 30 in which the pressure regulating means is a spring loaded relief valve to a port through the block a lower pressure region.

32. A modular engine comprising:

an engine block section providing at least a plurality of power cylindes having parallel axes and a central bore having an axis parallel to the cylinder axes;

a reciprocating piston in each of the cylinders;

an engine head section cooperating with and closing the end of the block section and having at least one port into each power cylinder at a common axial level at the end of the cylinders remote from drive means and supporting firing means associated with each of the power cylinders;

a bearing section cooperating with and closing the end of the engine head section and at least partially rotatably supporting a rotary valve;

a crank case section containing drive means connected to the pistons and the rotary valve producing reciprocation of the pistons in predetermined phased sequence, with at least a first pair of said power pistons in phase and a second pair 180° out of phase with said first pair, and producing rotation of the rotary valve phased so that air flows through at least one passageway to the power cylinders in time to be drawn in during the cylinder intake phase and so that the spent fuel is exhausted from power cylinder ports during the exhaust phase;

and separate axially arranged engine modular sections including the bearing section, the cylinder head section and the power section which are capable of being mechanically assembled to the crank case section in axial alignment or separated from one another such that the modular sections may be stockpiled so that the engine can alternatively be assembled with or without a supercharger section;

said rotary valve being rotatably supported by the engine block in the central boire providing at least one passageway successively connecting ports of the power cylinders to a source of air and at least one passageway successively connecting ports of the power cylinders to exhaust, and means providing closure for the inlet and outlet ports at other times.

33. The modular engine of claim 32 in which the engine is made in modular form and in which at least separate axially arranged engine modules, including the bearing section, the cylinder head section, the power section and a supercharger section are capable of being mechanically assembled to the crank case section in axial alignment or separated from one another and a rotary valve is employed which has at least one passageway for successive connecting ports of the supercharger cylinders with ports of the power cylinders and tandem pistons in axially aligned power and supercharger cylinders having an interconnecting rod between then are provided and connected to the drive means.

34. A composite engine employing modular units each in accordance with claim 32 in which the drive means is in a crank case which supports a first engine module and is capable of being connected through its crank shafts with a second similar engine module so that the respective engine modules are supported on and provided with means of attachment to the crank case at opposed sides thereof with their respective cylinders axially aligned with one another whereby the connecting rods from pistons in aligned cylinders of opposed engine modules can be attached to the crank shafts within the crank case whereby the opposed engines are able to be driven simultaneously by the same drive means.

35. The composite engine of claim 33 in which the drive means is in a crank case which supports a first engine module and is capable of being connected through its crank shafts with a second similar engine module so that the respective engine modules are supported on and provided with means of attachment to the crank case at opposed sides thereof with their respective cylinders axially aligned with one another whereby the connecting rods from pistons in aligned cylinders of opposed engine modules can be attached to the crank shafts within the crank case whereby the opposed engines are able to be driven simultaneously by the same drive means.

36. The composite engine of claim 34 in which crank shafts are extended and provided with extended crank case enclosure about such extension, said crank case extension having means whereby at least one additional engine module is mounted on the crank case in parallel with the other engine module opposed to one another, and said at least one engine module is coupled to the crank shafts at other positions along said crank shafts.

37. The composite engine of claim 36 in which said at least one additional engine module is opposed by still another engine module supported on the crank case with its cylinders axially aligned with those of said at least one additional engine module and which has its piston connections connected to its crank shafts immediately next to the piston connections of said at least one additional engine module.

38. The composite engine of claim 37 in which the crank case is further extended to accommodate additional parallel modular engine units.

39. The composite engine of claim 34 in which crank shafts are extended and provided with an extended crank case enclosure and coupled to similarly extended crank shafts of another engine by coupling means external to their respective crank cases and the respective crank cases or engine modules are supported on a common support structure whereby the engines all have their cylinder axes aligned parallel to one another and effectively contribute to driving the common coupled crank shafts.

40. A modular engine comprising engine block means providing:

at least a plurality of power cylinders having parallel axes;

a central bore having an axis parallel to the cylinders axes and having ports into each power cylinder at a common axial level at the end of the cylinders emote from drive means;

a reciprocating piston in each of the cylinders;

ignition means supported on the engine block means associated with each of the power cylinders;

separate axially arranged engine modular sections including a bearing section, a cylinder head section and a power section which are capable of being mechanically assembled to a crank case section in axial alignment or separated from one another such that the modular sections may be stockpiled so that the engine can alternatively be assembled with or without a supercharged section;

a rotary valve rotatably supported by the engine block means in the central bore providing at least one passageway successively connecting ports of the power cylinders with a source of air and directed into the successive cylinders generally in the direction of flow of the gases produced by the resultant centrifugal and tangential forces and at least one passageway successively connecting ports of the power cylindes to exhaust, and providing closure for the inlet and outlet ports at other times;

an drive means connected to the pistons and the rotary valve producing reciprocation of the pistons in predetermined phased sequence, with at least a first pair of said power pistons in phase and a second pair 180° out of phase with said first pair, and producing rotation of the rotary valve phased so that air flows through at least one passageway into the power cylinder during intake phase, and so that the spent fuel is exhausted from power cylinder ports during the exhaust phase.

41. The engine of claim 40 in which each cooperating port has a wall arranged generally tangentially to the cylinder wall so as to direct the input tangentially into the curved cylinder wall to induce a generally helical swirling motion of the gaseous flow.

42. The engine of claim 40 in which there are ports for intake at a level in each cylinder near the top of the piston at its position most withdrawn from the cylinder at bottom dead center and exhaust ports at a level in each cylinder near the top of the piston at its position furtherest into the cylinder at top dead center.

43. The engine of claim 42 in which each cooperating input port has a wall arranged generally tangentially to the cylinder wall so as to direct the input tangentially into the curved cylinder wall to induce a generally helical swirling motion of the gaseous flow.

44. The engine of claim 43 in which the power cylinders are provided with liners which are perforated at the power cylinder input ports to provide a grid, the bars of which are cut at an angle to radial and generally parallel to the generally tangential port wall in order to aid in directing the fluid flow into the generally helical swirling mode.

* * * * *

UNITED STATES PATENT AND TRADEMARK OFFICE

CERTIFICATE OF CORRECTION

PATENT NO. : 4,777,917

DATED : October 18, 1988

INVENTOR(S) : Thomas V. Williams

It is certified that error appears in the above-identified patent and that said Letters Patent is hereby corrected as shown below:

Column 3, line 6, "underide" should read --underside--.
Column 5, line 9, after "view" insert --from--.
Column 15, line 57, "pistions" should read --pistons--.
Column 17, line 64, "scop" should read --scope--.
Column 20, line 65, "cylindes" should read --cylinders--.
Column 21, line 30, "boire" should read --bore--;
line 49, "then" should read --them--.
Column 23, line 1, "an" should read --and--.
Abstract, third to last line, "cylinder" (first occurrence) should read --cylinders--.

Signed and Sealed this

Third Day of October, 1989

*Attest:*

DONALD J. QUIGG

*Attesting Officer*

*Commissioner of Patents and Trademarks*